United States Patent [19]

Varner

[11] 4,170,883

[45] Oct. 16, 1979

[54] PRINTING OF PATTERN DESIGNS WITH COMPUTER CONTROLLED PATTERN DYEING DEVICE

[75] Inventor: George C. Varner, Moore, S.C.

[73] Assignee: Milliken Research Corporation, Spartanburg, S.C.

[21] Appl. No.: 900,991

[22] Filed: Apr. 28, 1978

Related U.S. Application Data

[62] Division of Ser. No. 686,900, May 17, 1976, Pat. No. 4,116,626.

[51] Int. Cl.[2] ..... D06B 1/02; D06B 11/00

[52] U.S. Cl. ..... 68/205 R; 118/697; 118/314

[58] Field of Search ..... 68/200, 203, 205 R; 101/172; 118/11, 314, 315

[56] References Cited

U.S. PATENT DOCUMENTS 3,783,654 1/1974 Crawford ..... 8/149 X 3,894,413 7/1975 Johnson ..... 68/205 R 4,033,154 7/1977 Johnson ..... 68/205 R

*Primary Examiner*—Philip R. Coe

[57] ABSTRACT

A plurality of jet gun bars are spaced apart along the path of travel of a textile material and responsive to pattern data to form patterns on the material. Each gun bar stores and supplies different color dyestuff to color the material. A computer, on each periodic request, supplies pattern data to a predetermined number of gun bars, thereby providing dyestuff to different pattern lines for each request. During a change from printing one pattern to printing another different pattern, for each such request the computer provides data for the other pattern to a first predetermined number of gun bars and data for the one pattern to a second predetermined number of gun bars subsequent to the first number, thereby simultaneously completing the printing of the one pattern and starting the printing of the other pattern.

2 Claims, 25 Drawing Figures

TABLES / COUNTERS

PATTERN TABLE

| |
|---|
| (1) # OF GUN BARS USED<br>(2) DISK ADDRESS<br>(3) PATTERN LENGTH<br>(4) # OF REPEATS<br>(5) PATTERN WIDTH |
| (PER PATTERN) |

FIG. 10A

SYSTEM VARIABLES (1) STOP COUNTER
(2) START COUNTER
(3) STOP LENGTH
(4) START LENGTH
(5) POINTER TO CURRENT PATTERN # 1 IN PATTERN TABLE
(6) STOP DATA FLAG
(7) STOP REQUESTED FLAG
(8) START REQUESTED FLAG
(9) POINTERS TO INPUT BUFFERS
(10) POINTERS TO OUTPUT BUFFERS
(11) DELAY LENGTH
(12) DELAY COUNT

FIG. 10D

OUTPUT TABLE

| | |
|---|---|
| (1) # OF GUN BARS TO OUTPUT<br>(2) LINE ADDRESS<br>(3) WORD COUNT (1 GUN BAR)<br>(4) FIRST GUN BAR TO OUTPUT | PATTERN # 1 |
| (1) # OF GUN BARS TO OUTPUT<br>(2) LINE ADDRESS<br>(3) WORD COUNT (1 GUN BAR)<br>(4) FIRST GUN BAR TO OUTPUT | PATTERN # 2 |

FIG. 10B

PATTERN # 1, PATTERN # 2 VARIABLES / COUNTERS (1) # OF REPEATS
(2) FIRST LINE # IN INPUT BUFFER
(3) PATTERN LENGTH
(4) DISK ADDRESS
(5) LINE # TO REQUEST

FIG. 10C

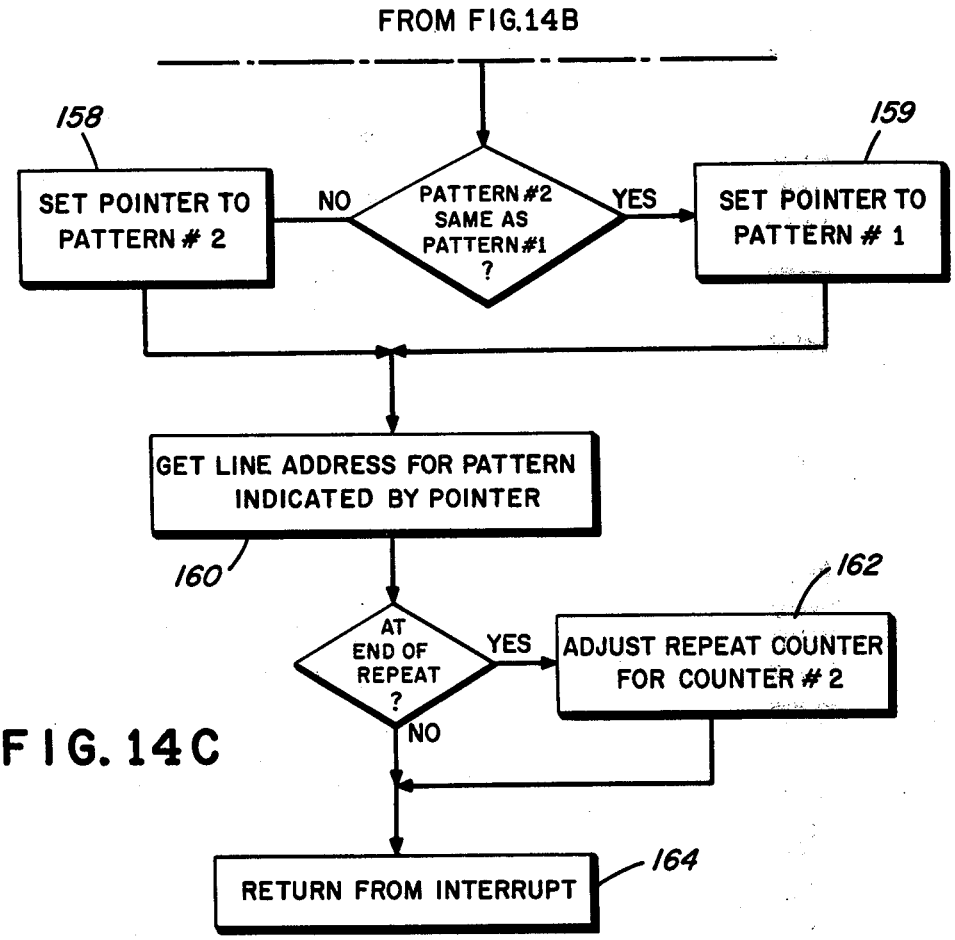
FIG. 14C
FIG. 18A
START REQUESTED INTERRUPT
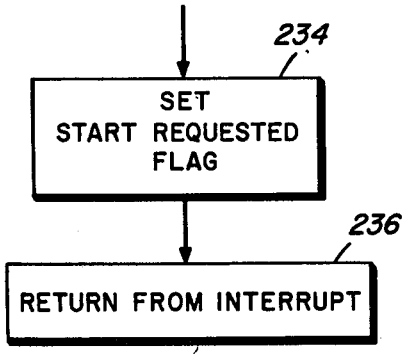
FIG. 18B
STOP REQUESTED INTERRUPT
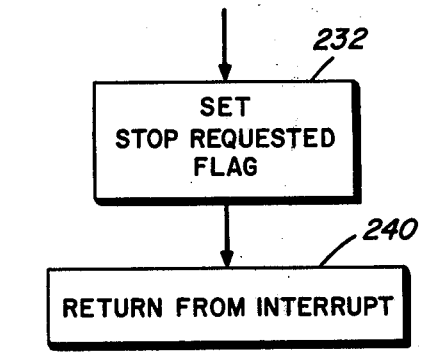

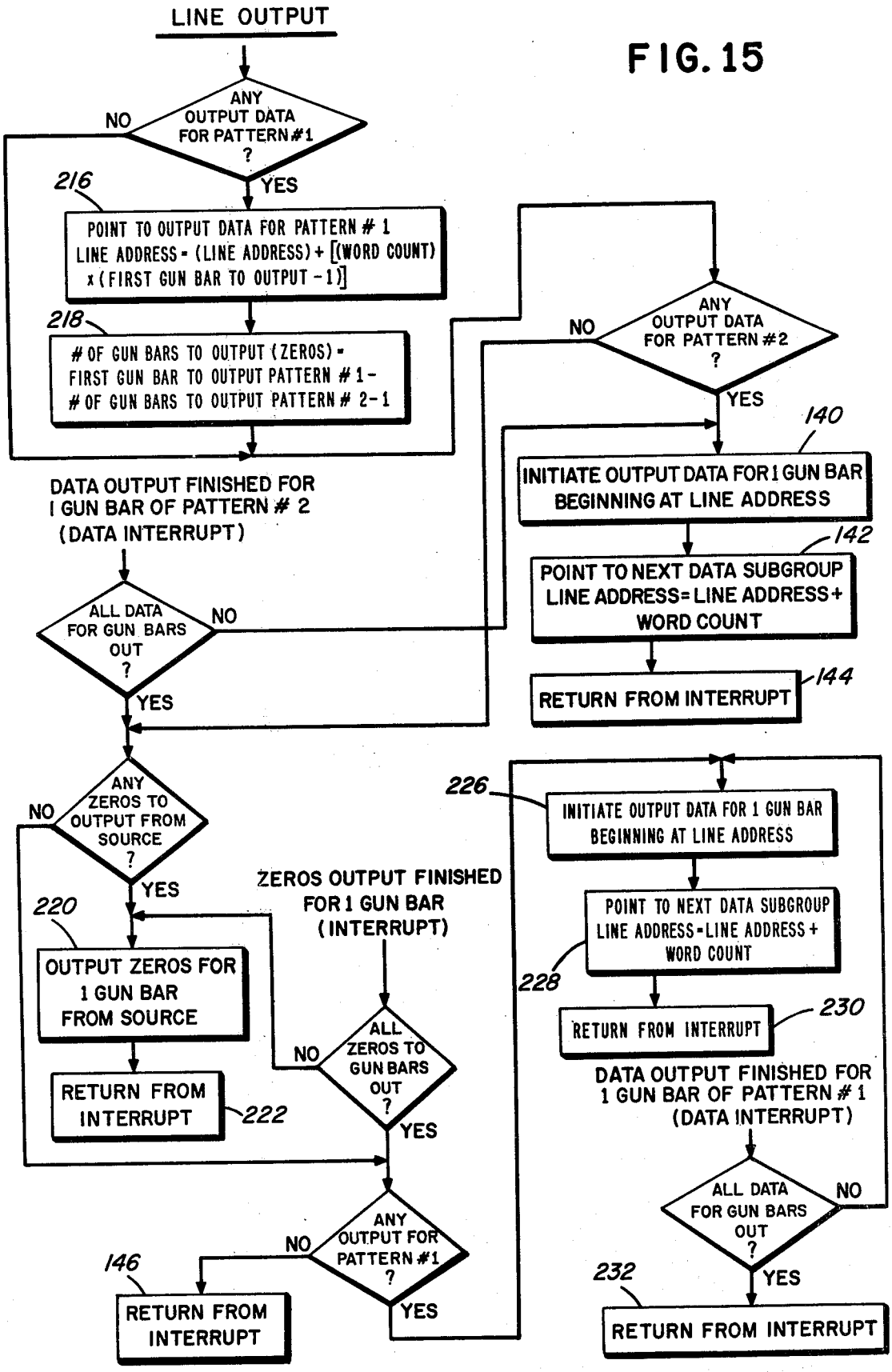
LINE OUTPUT
FIG. 15
ANY OUTPUT DATA FOR PATTERN #1 ?
NO
YES
216
POINT TO OUTPUT DATA FOR PATTERN # 1
LINE ADDRESS = (LINE ADDRESS) + [(WORD COUNT) x (FIRST GUN BAR TO OUTPUT - 1)]
218
OF GUN BARS TO OUTPUT (ZEROS) = FIRST GUN BAR TO OUTPUT PATTERN # 1 - # OF GUN BARS TO OUTPUT PATTERN # 2 - 1
ANY OUTPUT DATA FOR PATTERN #2 ?
NO
YES
140
INITIATE OUTPUT DATA FOR 1 GUN BAR BEGINNING AT LINE ADDRESS
142
POINT TO NEXT DATA SUBGROUP LINE ADDRESS = LINE ADDRESS + WORD COUNT
RETURN FROM INTERRUPT
144
DATA OUTPUT FINISHED FOR 1 GUN BAR OF PATTERN # 2 (DATA INTERRUPT)
ALL DATA FOR GUN BARS OUT ?
NO
YES
ANY ZEROS TO OUTPUT FROM SOURCE ?
NO
YES
220
OUTPUT ZEROS FOR 1 GUN BAR FROM SOURCE
RETURN FROM INTERRUPT
222
ZEROS OUTPUT FINISHED FOR 1 GUN BAR (INTERRUPT)
ALL ZEROS TO GUN BARS OUT ?
NO
YES
ANY OUTPUT FOR PATTERN #1 ?
NO
YES
146
RETURN FROM INTERRUPT
226
INITIATE OUTPUT DATA FOR 1 GUN BAR BEGINNING AT LINE ADDRESS
POINT TO NEXT DATA SUBGROUP LINE ADDRESS = LINE ADDRESS + WORD COUNT
228
RETURN FROM INTERRUPT
230
DATA OUTPUT FINISHED FOR 1 GUN BAR OF PATTERN # 1 (DATA INTERRUPT)
ALL DATA FOR GUN BARS OUT ?
NO
YES
232
RETURN FROM INTERRUPT

PRINTING OF PATTERN DESIGNS WITH COMPUTER CONTROLLED PATTERN DYEING DEVICE

This is a division of application Ser. No. 686,900 filed May 17, 1976, and now U.S. Pat. No. 4,116,626.

BACKGROUND OF THE INVENTION

This invention relates to apparatus for applying dyestuffs and other liquids to moving textile material and, more particularly, to apparatus for printing different patterns on the material and eliminating unprinted spaces on the material between different patterns. The invention also relates to a product having a number of different patterns thereon.

Textile fibers and fabric materials have long been colored with natural and synthetic dyes and, in particular, printed by color decoration of the surface or surfaces of the materials in definite repeated forms and colors to provide a pattern. Such color printing of textile fabrics has been accomplished in various ways. Earlier forms of printing used carved blocks charged with colored paste pressed against the fabric. Subsequently, speed of printing was increased by development of roller printing wherein moving fabrics are sequentially contacted by engraved metal rollers each containing a different color dye to form the desired pattern thereon. Textile fabrics are also printed by sequential contact with screens each having a porous portion of a pattern and carrying a particular color dyestuff.

One disadvantage encountered with conventional printing by machines using rollers or screens is that they are not economically feasible for printing short runs of one pattern. The time and cost involved in assembling and operating a machine with rollers or screens for one pattern requires that a minimum number of this one pattern be printed to make the run profitable. If a customer places an order for less than this minimum number either the order may have to be refused or an expenditure made for storing the extra patterns produced as inventory.

Also, though machines using rollers and screens have increased the speed of textile printing, it still requires considerable time to assemble and disassemble such machines. Once a machine is assembled to print repeats of one pattern, it is not feasible to switch quickly to a new pattern. Thus, for example, if it were important to service the rush order of a customer to print short runs of a number of different patterns, this order might not be able to be completed within the required time period.

In prior U.S. pat. application Ser. No. 683,224, filed May 4, 1976, and now U.S. Pat. No. 4,033,154, which is a continuation of application Ser. No. 477,461, filed July 7, 1974, (now abandoned), which application is incorporated by reference herein, there is described apparatus for the printing of textile fabrics. This apparatus includes an electronic control system and is used with a jet printing machine having a series of gun bars, each containing plural dye jets extending across the width of an endless conveyor. The gun bars are spaced along the conveyor, and textile materials are carried by the conveyor past the gun bars where dyes are applied to form a pattern thereon. On each periodic line request, which is a request for data for all gun bars used to print the pattern, the electronic control system receives, from a computer, pattern data for all the gun bars. The system demultiplexes and transmits the data to respective gun bars to control the plural dye jets of the gun bars. Thus, on such line request, each gun bar applies dyestuff to a different line of the textile material in accordance with the pattern information it receives, and when one line of textile material has passed beneath all gun bars the required colors will have been printed for that line.

The apparatus described in the above-mentioned U.S. application Ser. No. 683,224 has been in use for more than a year to produce and sell textile material having patterns thereon. In such use this apparatus prints a predetermined number of repeats of a desired pattern. Though not described in the application Ser. No. 683,224, to finish the last line of the last repeat of the pattern, this last line first passes gun bar #1 where it may receive a color in a section along the line as determined by the pattern data. As this last line then moves towards gun bar #2, gun bar #1 does not do any printing as it has now completed printing the last line, though the other gun bars continue to print the lines of material preceding the last line. When such last line reaches gun bar #2, it may receive a color from this gun bar in a different section of the line and then while this line is moving toward gun bar #3, gun bars #1 and #2 do not print since the last line has passed the latter two. Again, though, the gun bars other than gun bars #1 and #2 may print the lines preceding the last line. This process continues until such last line passes the last gun bar at which time all the gun bars do not print a respective color on the textile material. Similarly, when starting to print the first repeat of a pattern, only when the first line of this first repeat moves under a gun bar is the gun bar activated to apply a respective color to this first line in accordance with the pattern data. Consequently, when completing the printing of a final repeat or starting the printing of a first repeat the gun bars are sequentially deactivated or activated, respectively.

The advantages of the above-described apparatus of application Serial No. 683,224 are that it is possible to print economically a short run of one pattern, and to change quickly and economically from printing a run of one pattern to printing a run of a different pattern. This is because there is no need to assemble and disassemble the machine, including the gun bars, each time a new pattern is to be printed. Pattern data for different patterns is stored in the computer which is suitably programmed to output data to print a predetermined number of repeats of one pattern and then a predetermined number of repeats of another pattern, and so on until the required number of repeats of each pattern is printed. Since only this programming is required, it is economical to print short runs of each of the different patterns, and it is possible to switch quickly from printing one pattern to printing another pattern.

A disadvantage of the above-described apparatus of U.S. Ser. No. 683,224, as a result of the sequential stopping of the gun bars, is that gun bar #1 cannot begin printing a new pattern until the last gun bar used to print the previous pattern stops printing the latter. Consequently, a section of textile material equal to the sum of the distances between all gun bars used for the previous pattern is left unprinted and this results in a waste of valuable textile material.

Such waste is not insubstantial. For example, the apparatus may be programmed to print 3 repeats each of 5 different patterns with the dimensions of each pattern being 90′ by 12′. If the sum of the distances between all the gun bars used is about 8′–9′, which is typical, for every 3 repeats printed there is a textile loss approximately equivalent to one repeat. The present invention has the advantage of avoiding this waste by printing the first repeat of a new pattern immediately after the last repeat of the previously printed pattern.

SUMMARY OF THE INVENTION

It is an object of the present invention to provide a novel apparatus for applying different patterns on textile material without loss of material between the different patterns.

It is another object of the present invention to print simultaneously two different patterns on the textile material when changing from one pattern to a different pattern.

It is yet another object of the present invention to store and process data for at least two different patterns in a manner which permits two different patterns to be produced on the textile material without a loss of material or gap between them.

These and other objects are obtained by storing in a computer data for at least two different patterns in one or more mass storage means. A first buffer means in a computer stores a number of lines of first pattern data for a number of line requests, each line having data for the gun bars. A second buffer means in the computer stores a number of lines of second pattern data for a number of line requests, each line also having data for the gun bars. A machine storage disclosed in the electronic control system of the Johnson application Ser. No. 683,224 temporarily stores one line of data for the gun bars for one line request to apply colors on the textile material.

In operation, a section of first pattern data from the mass storage means is transferred to the first buffer means. For every predetermined amount of movement of the textile material, a line request is generated and one line of data for the gun bars is sent from the first buffer means to the machine storage which then outputs this data to control the respective gun bars, i.e., to cause the gun bars to "fire" or apply dyestuff to the respective lines of textile material under the gun bars in accordance with the data. During the time the first pattern is repeatedly being produced by continuously loading the first buffer means with first pattern data, the second pattern data is being readied for transfer to the machine storage for each line request.

A counter counts the number of repeats of the first pattern to be produced. When the last line of the last repeat of the first pattern has been completed by gun bar #1, data for gun bar #1 is transferred from the second buffer means to the machine storage while data for the remaining gun bars is transferred from the first buffer means to the machine storage, thereby controlling the gun bars to produce simultaneously different patterns. This process continues with more and more data being transferred from the second buffer means and less data being transferred from the first buffer means as the first line of the new pattern is moved under addition gun bars. When such first line is moved past the last gun bar data is taken only from the second buffer means, and the first buffer means is readied for transfer of data of a third pattern to the machine storage in a like manner when the last line of the last repeat of the second pattern passes gun bar #1. A second counter counts the number of repeats of the second pattern to determine when to change to produce a new pattern.

BRIEF DESCRIPTION OF THE DRAWINGS

FIGS. 10A–10D list tables and variables for processing data in accordance with the present invention.

FIGS, 14A, 14B and 14C are flow charts for processing a line request for pattern data.

FIG. 15 is a flow chart for outputting a line of pattern data.

Figure 16:
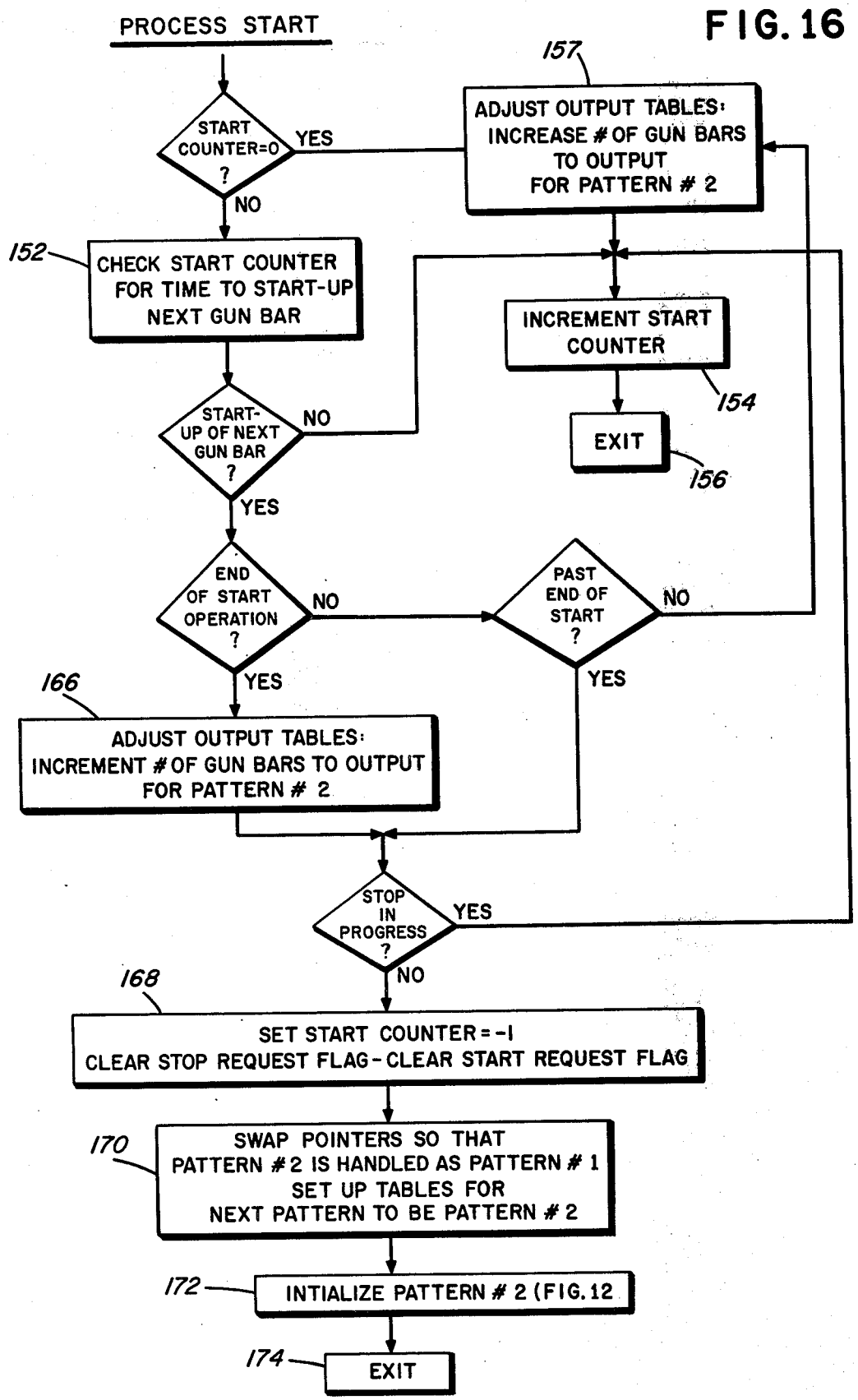

FIG. 16 is a flow chart to process the start of printing a pattern.

Figure 17:
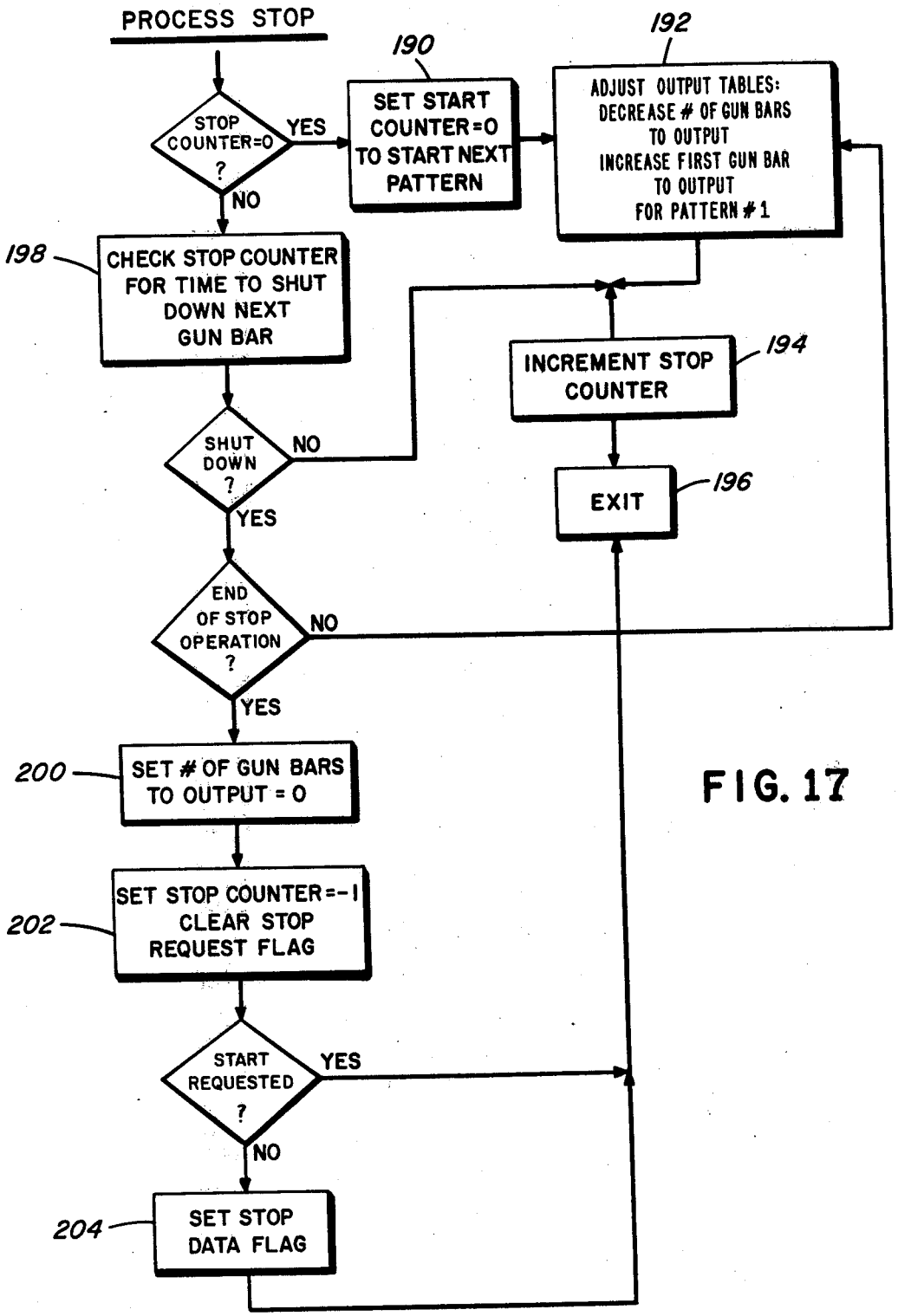

FIG. 17 is a flow chart to process a stop in the printing of a pattern.

FIGS. 18A and 18B are flow charts for processing machine operator initiated starts and stops of printing a pattern, respectively.

DETAILED DESCRIPTION OF THE DRAWINGS

Figure 1:
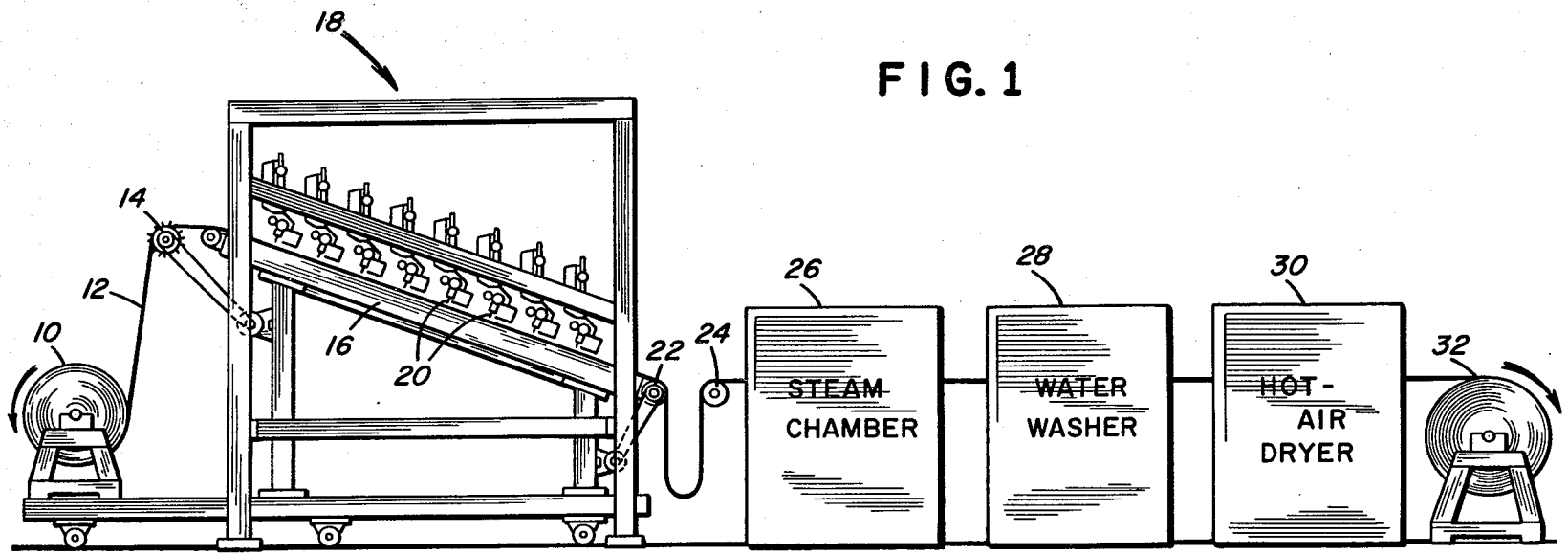
FIG. 1 is a schematic side elevation of apparatus for the jet dyeing and printing of textile materials.

FIG. 1 shows a jet printing apparatus for printing patterns on textile materials, such as pile carpets. The apparatus consists of a delivery roll 10 from which a roll of pile carpet 12 is continuously fed over a feed roll 14 onto the upper end of an inclined endless conveyor 16 of an injection dyeing machine 18, where the carpet is suitably printed by the programmed operation of a plurality of applicator means or jet gun bars, generally indicated at 20, which dispense streams of dye or other liquid onto the carpet 12 during its passage. The printed carpet leaving the dyeing machine 18 is moved over rollers 22, 24 to a steam chamber 26 where the carpet 12 is subjected to a steam atmosphere to fix the dyes on the textile material. The printed carpet leaving steam chamber 26 is conveyed through a water washer 28 to remove excess unfixed dye from the carpet, and then passes through a hot air dryer 30 to a take-up roll 32 where the dried carpet is accumulated for subsequent use.

Figure 2:
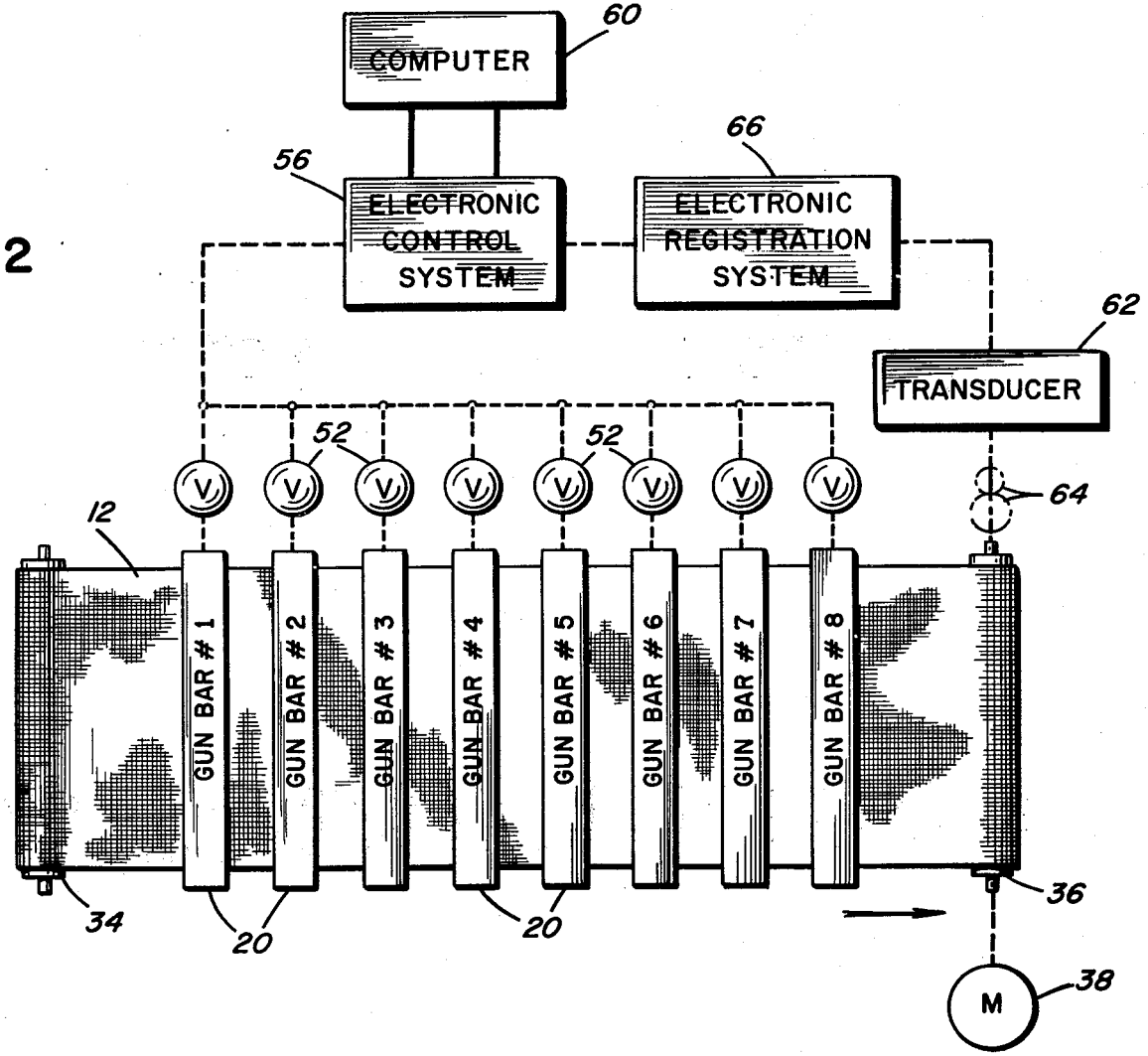
FIG. 2 is an enlarged schematic plan view of the jet dye applicator section of the apparatus of FIG. 1, showing in more detail the cooperative relation and operation of the conveyor with the jet gun bars and the pattern control components of the apparatus.
Figure 3:
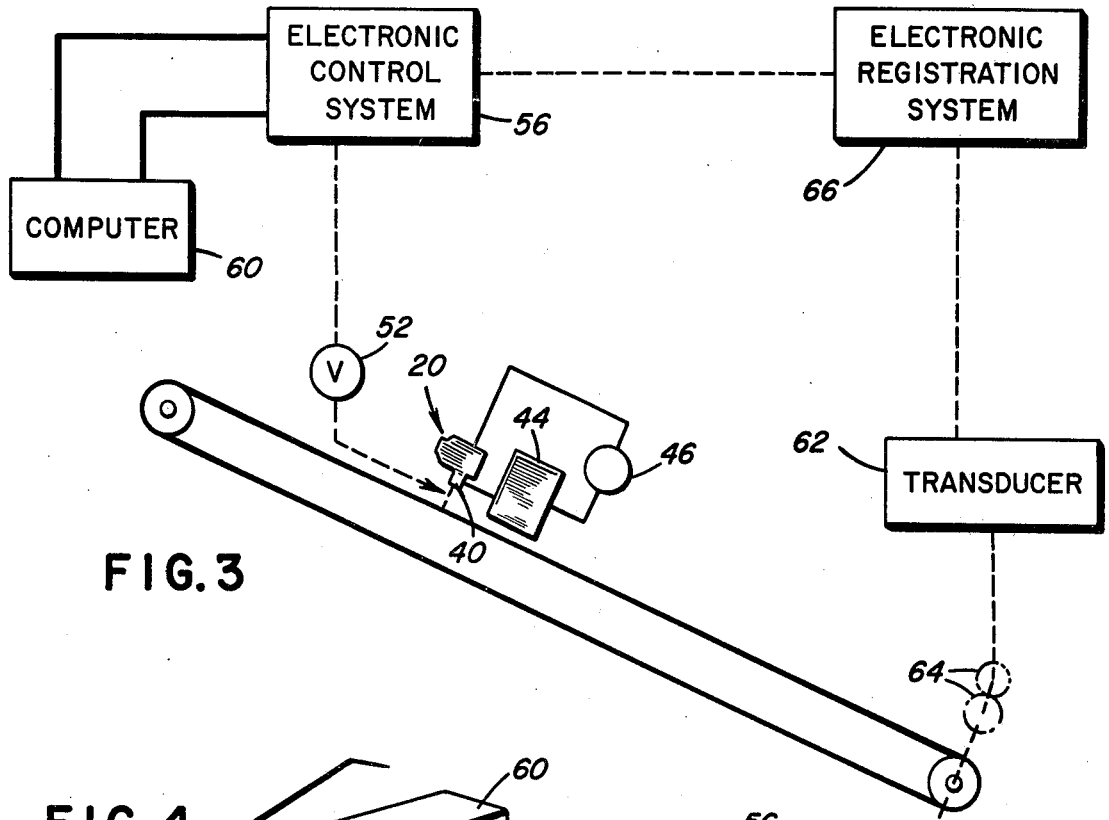
FIG. 3 is a schematic side elevation view of the jet dye applicator section seen in FIG. 2 and showing only a single jet gun bar of the applicator section and its operative connection to the dyestuff supply system for the gun bars.
Figure 4:
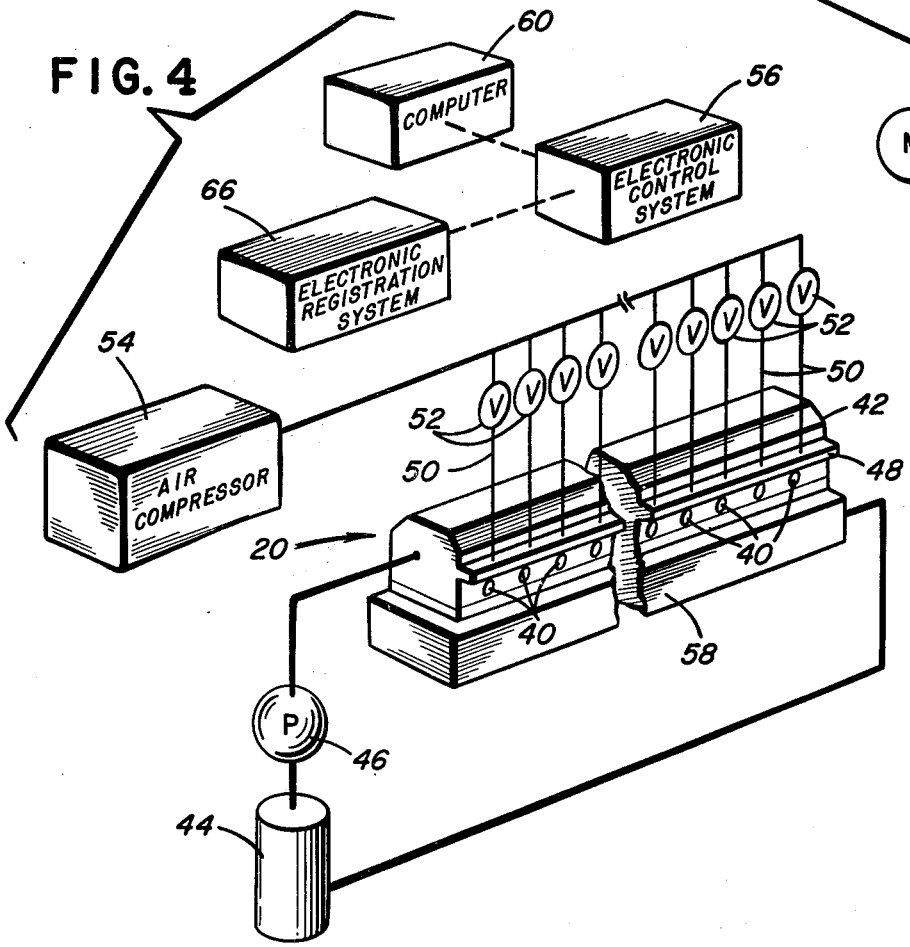
FIG. 4 is a more detailed perspective view of the jet gun bar seen in FIG. 3, and shows its operative connection to the dye supply system.

Details of the apparatus, which will be helpful in understanding the present invention, are further shown by reference to FIGS. 2–4. FIG. 2 is an enlarged schematic plan view of the injection dyeing machine 18 of FIG. 1 and shows the endless conveyor 16 moving in the direction of the arrow, the supporting chains and sprockets of which (not shown) are suitably supported for movement on rotatable shafts 34, 36, one of which, 36, is driven by a motor 38. During movement of the conveyor, the carpet 12 passes sequentially adjacent and beneath substantially identical gun bars 20, spaced along the path of travel of the conveyor and extending across its full width, each gun bar containing a different color dye or other liquid. Though eight such gun bars #1–#8 are indicated in this drawing, any number of gun bars may be used, depending on the number of colors required for a pattern.

As best seen in FIGS. 3 and 4 which show only a single gun bar 20, for sake of clarity, each gun bar contains a plurality of individual jet orifices 40 disposed along the bar and positioned to direct dye in narrow streams toward the surface of the pile carpet 12 as it passes thereby. Each gun bar 20 includes a dye supply manifold 42 (FIG. 4) communicating with the jet orifices 40 and supplied with liquid dye from a separate dye reservoir tank 44. A pump 46 supplies liquid dye under pressure from the reservoir tank 44 to manifold 42 and the jet orifices 40. During operation, liquid dye is expelled continuously in small streams or jets from the orifices 40 toward the material to be printed.

Positioned adjacent and at a right angle to the outlet of each jet orifice 40 are outlets 48 for air supply tubes 50 (FIG. 4), each of which communicates with a separate solenoid valve 52 (FIG. 4). The solenoid valves 52 are suitably supported in the injection dyeing machine 18 and are supplied with air from an air compressor 54 (FIG. 4). Although the valves for each gun bar are shown in FIGS. 2 and 3 as a single valve symbol 52 for clarity, it is to be understood that a solenoid valve and individual air supply tube are provided for each jet orifice of each gun bar such that individual streams of dye can be individually controlled, as shown in FIG. 4.

The valves 52 are controlled by a pattern control device or electronic control system 56 to cause normally directed streams of air to impinge against the continuously flowing dyestreams and deflect the same into a catch basin or trough 58 from which the dye is recirculated to the dye reservoir tank 44. The control system 56 for operating the solenoid valves receives pattern data from a computer 60 which stores data for at least two different patterns and provides a repeating sequence of data for one pattern that is transmitted to the solenoid valves until a desired number of repeats has been printed, and then provides a repeating sequence of data to the valves for the other pattern until a desired number of repeats has been printed. The control system 56 is periodically activated to request the pattern data from the computer 60 as the carpet 12 passes beneath the gun bars 20. The pattern data is processed by the control system 56 and transferred to the solenoid valves 52 to turn them off or on to print a desired pattern on the carpet 12 as it passes beneath the gun bars 20.

In the operation of the apparatus of FIGS. 2–4 with the electronic control system 56 processing no pattern data, dye under pressure is continuously supplied in a stream from each jet orifice 40 toward the carpet to be printed. Every solenoid valve 52 is normally open to supply streams of air to impinge against the continuously flowing dye streams and deflect them all into the trough 58 of the gun bars for recirculation. As the carpet 12 passes beneath the gun bars 20 the electronic control system 56 is periodically activated and certain of the normally open solenoid air valves 52 for each gun bar are closed in accordance with the pattern data so that the corresponding dye streams are not deflected, but impinge directly upon the carpet. Thus, by opening and closing the solenoid air valves in a desired sequence, a printed pattern of dye is placed on the carpet during its passage beneath the gun bars 20.

Dyestuff must be placed on the carpet at the precise location desired for good pattern definition and registration. This is accomplished by periodically activating the electronic control system 56 to request pattern data from the computer 60 when the carpet on the conveyor 16 has moved a predetermined incremental amount. The apparatus for enabling the electronic control system 56 to request data is shown in FIGS. 2–4 and comprises a transducer 62 operatively connected to the shaft 36 via gears 64 to convert mechanical movement of conveyor 16 to an electrical signal, and an electronic registration system 66.

A detailed description of the apparatus for enabling the electronic control system 56 is disclosed in U.S. Pat. No. 3,894,413, July 15, 1975 by Harold L. Johnson and assigned to the assignee of the present invention. As taught therein, the transducer 62 and registration system 66 function to generate an enabling pulse every 1/10" of travel of the conveyor 16, which pulse is transmitted to control system 56. Consequently, system 56 is enabled to request and then receive pattern data for dispensing dyestuff each 1/10" movement of the conveyor 16.

The control system 56 is the subject matter of the above-mentioned U.S. application Ser. No. 683,224 and is described in detail therein. Basically, at each 1/10" movement of the conveyor 16, in response to the enabling pulse, the system 56 receives a block or group of pattern data in serial bit stream from computer 60, this group comprising 8 subgroups of data, and distributes each subgroup to a respective one of the 8 gun bars #1–#8. Each subgroup comprises a number of bits equal to the number of valves 52 to thereby control the opening and closing of a valve by a respective bit. Thus, each subgroup includes pattern data for a different line of carpet 12 under a respective gun bar 20.

The present invention of printing at least two different patterns on the pile carpet 12 without any gap between the different patterns is carried out by uniquely processing data in the computer 60 and transferring data in serial bit stream from computer 60 to electronic control system 56 at a proper time. That is, computer 60 stores the data for the two different patterns and when changing from printing one pattern to another the computer transfers groups of data to the control system 56, each such group having subgroups of data for both patterns. Thus, whether control system 56 receives a group of data from a computer as described in application Ser. No. 683,224 to print one pattern, or receives a group of data for printing two different patterns simultaneously, the system 56 functions and operates the same to distribute the data to the gun bars 20. Therefore, a detailed explanation of system 56 is not considered necessary for an understanding of the present invention.

Figure 5:
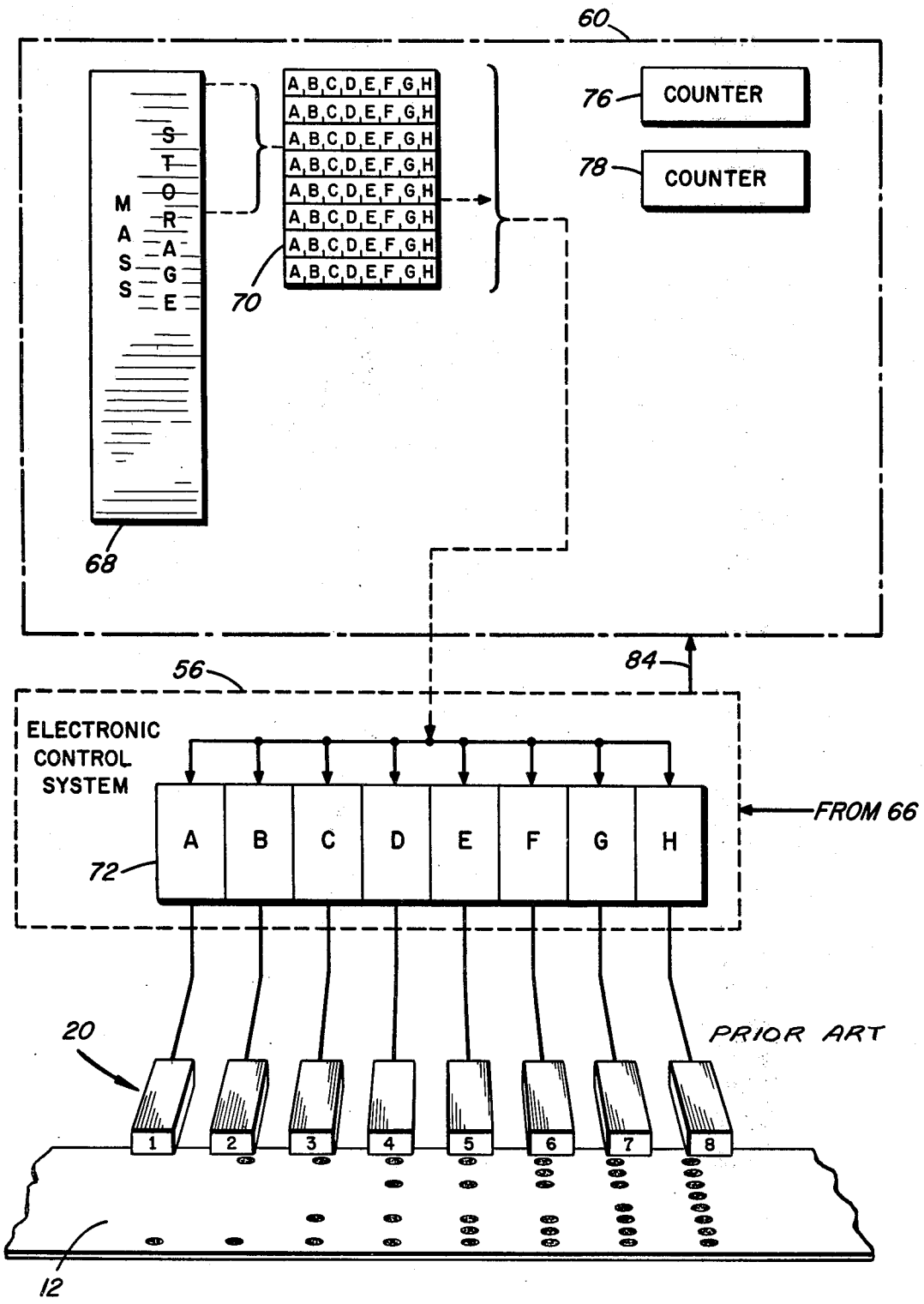
FIG. 5 is a schematic view of a prior apparatus and method for printing patterns.

FIG. 5 illustrates schematically an example of the manner in which the apparatus disclosed in the application Ser. No. 683,224 has been in use for more than a year. This figure will be described assuming the pattern to be printed requires the 8 colors of the gun bar. Inside computer 60, a mass storage means 68, such as a disk, stores pattern data for a pattern to be printed. The pattern data is logically grouped on the disk 68 by pattern lines, i.e., each line on the disk has a group of data for gun bars #1–#8 in that order and hence for different pattern lines on the carpet. Each gun bar is caused to print substantially simultaneously; therefore, the data in a group for each gun bar must be for a pattern line on the carpet determined by the distance between gun bars. For example, if the distance between gun bars is 150 pattern lines, then one group in a line on the disk may comprise gun bar #1 data for pattern line 1400, gun bar #2 data for pattern line 1250, gun bar #3 data for pattern line 1100, gun bar #4 data for pattern line 950, etc. This implies that the pattern is at least 1400 pattern lines in length.

The computer 60 includes a buffer means 70 in core which stores temporarily a section of data comprising several groups of data transferred from the disk 68 to the buffer means. Each group of data comprises 8 subgroups A–H for the respective gun bars #1–#8. On receipt of each line request (i.e., enabling pulse) from registration system 66, control system 56 requests data from computer 60 and one group of data is then sent from buffer means 70 to a machine storage 72 in the system 56 which temporarily stores the data before it is sent to the gun bars. Machine storage 72 corresponds to the distributors described in the Johnson U.S. application Ser. No. 683,224.

Internally of the computer 60 are two counters 76, 78. Counter 76 is set with a count equal to the number of lines from disk 68 that the buffer means 70 has capacity for, and has its count decremented by 1 each time a line of data is transferred to machine storage 72. Counter 78 is set with a count corresponding to the number of repeats of the pattern to be printed, and has its counter decremented by 1 each time the last section of pattern data is used to complete the pattern. Also, the computer program clears data at the proper time from one or more subgroups A–H stored in buffer means 70 to stop sequentially each gun bar from "firing," i.e., from applying dyestuff on the carpet, when the final repeat of the pattern is being completed.

In operation, assume a section of data from disk 68 is stored in buffer means 70. When conveyor 16 moves 1/10", control system 56 receives a line request from registration system 66 and sends a signal over line 84 to request data from the computer. At this time a group of data is transferred as a whole in serial bit stream from buffer means 70 to machine storage 72 which then transmits the data to the respective gun bars #1–#8, as described in the above-mentioned Johnson application Ser. No. 683,224. After the group of data is transferred to machine storage 72, counter 76 is decremented by 1. Whenever counter 76=0, thereby indicating that all the data in buffer means 70 has been used, pattern data from the next section on the disk 68 is transferred to buffer means 70.

Whenever the final section of pattern data on the disk 68 is used, counter 78 has its count decremented by 1. If counter 78 indicates that more repeats of the pattern are needed, then the first section of pattern data is transferred to the buffer means 70 and the same processing continues to print another repeat.

If the counter 78 equals 0 it indicates that the final repeat is being printed and that the gun bars should be caused sequentially to stop "firing." This sequential stop in firing is performed by the computer program clearing the data in the buffer means 70 with 0's at the proper time before the data is transferred to the machine storage 72. Thus, if the final pattern line of the final repeat has just passed gun bar #1, the group of data next to be transferred to storage 72 upon a line request has 0's forced into subgroup A with data remaining in subgroups B–H. Thus, gun bar #1 does not fire while the other gun bars fire to supply dyestuff to the lines on the carpet preceding such last line in accordance with the pattern data.

The 0's are forced only into subgroup A in each group stored in buffer means 70 until the final line of the final repeat passes gun bar #2. Then, 0's are forced only into subgroups A and B of each group to cause gun bar #2 also to cease firing while the other gun bars #3–#8 continue to fire in accordance with the pattern data. This process continues until the last line of the final repeat passes gun bar #8 at which time all the gun bars have ceased firing. When all the gun bars have ceased firing, unless a new pattern is to be printed, the computer is programmed to prevent data from being transferred to storage 72 even though a line request is generated due to continued movement of conveyor 16. Thus, all the solenoids 52 are returned to their normally open state and prevent dye from impinging on carpet 12.

Mass storage means 68 of FIG. 5 also stores pattern data for at least one other pattern to print, if desired. When the last repeat of the first pattern has been printed and all the gun bars sequentially stopped firing, buffer means 70 will have stored in it pattern data to start printing the new pattern by sequentially starting to fire the gun bars. As the first line on the carpet of the first repeat passes gun bar #1, subgroup data A is transferred from the buffer means 70 to storage 72 and then to gun bar #1. Subgroups B–H will have been cleared of data in buffer means 70 so that gun bars #2–#8 will not fire. This continues until the first line of the first repeat of the new pattern passes under gun bar #2, at which time storage 72 receives subgroups A, B from buffer means 70 to fire gun bars #1, #2, respectively, the other gun bars still not firing since subgroups C–H will be cleared with 0's, and so on until start-up is complete with the necessary gun bars firing in accordance with the data they receive. Thus, when changing from printing one pattern to printing a different pattern, conveyor 16 moves continuously to generate line requests, but the different patterns are not printed simultaneously.

Figures 6A, 6B:
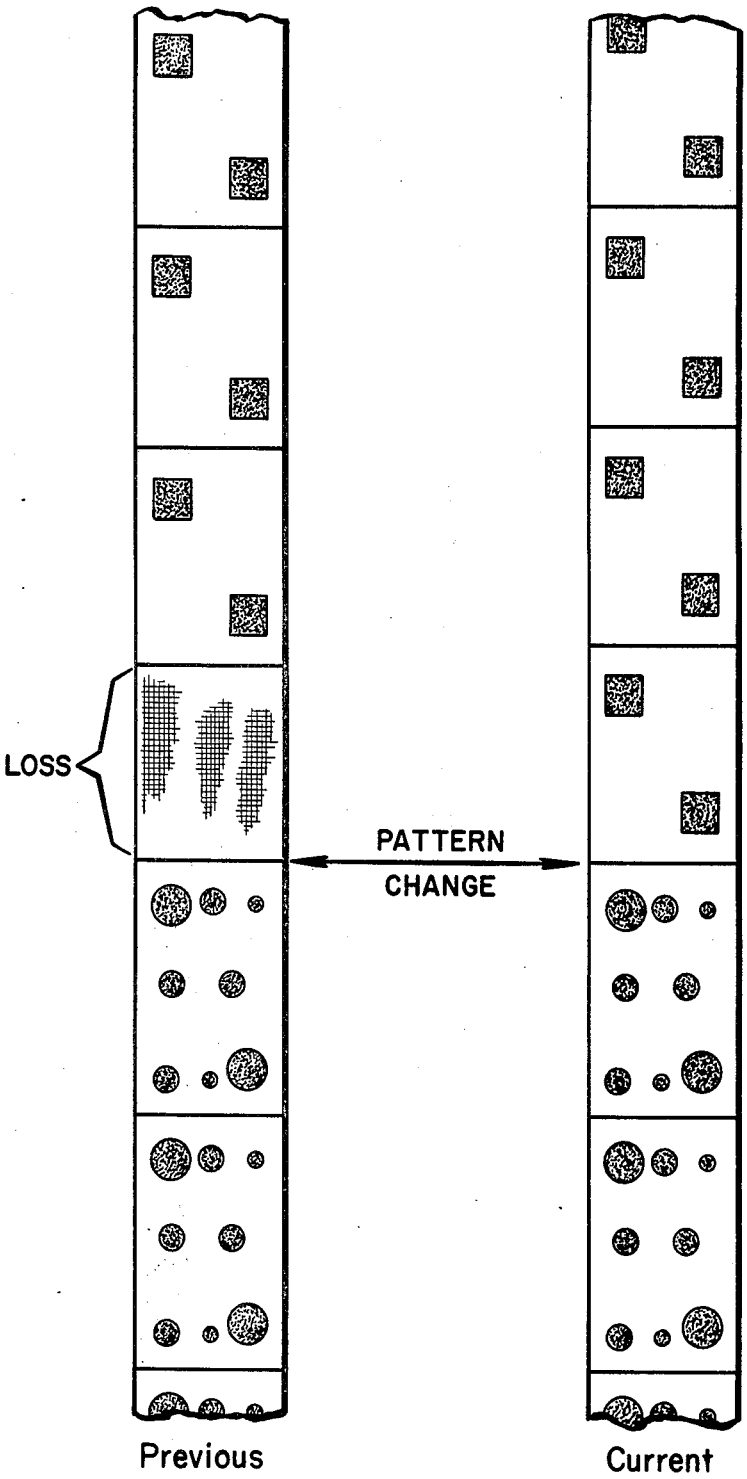
FIGS. 6A and 6B illustrate, respectively, the results of printing different patterns with a prior system and the present invention.

The result of sequentially stopping the firing of the gun bars is shown in FIG. 6A. There is a gap on the pile carpet equal to the distance between gun bar #1 and gun bar #8, resulting in a loss of material. When the different pattern is started-up there will be a gap between the first repeat of this pattern and the last repeat of the previous pattern.

FIG. 6B illustrates pictorially the advantage of the present invention. When changing from printing one pattern to printing another, there need be no gap on the carpet at the pattern change and, hence, no carpet loss. However, as will be described, the present invention may provide from a small gap to enable the carpet to be cut between the different patterns without destroying parts of either pattern.

Figure 7:
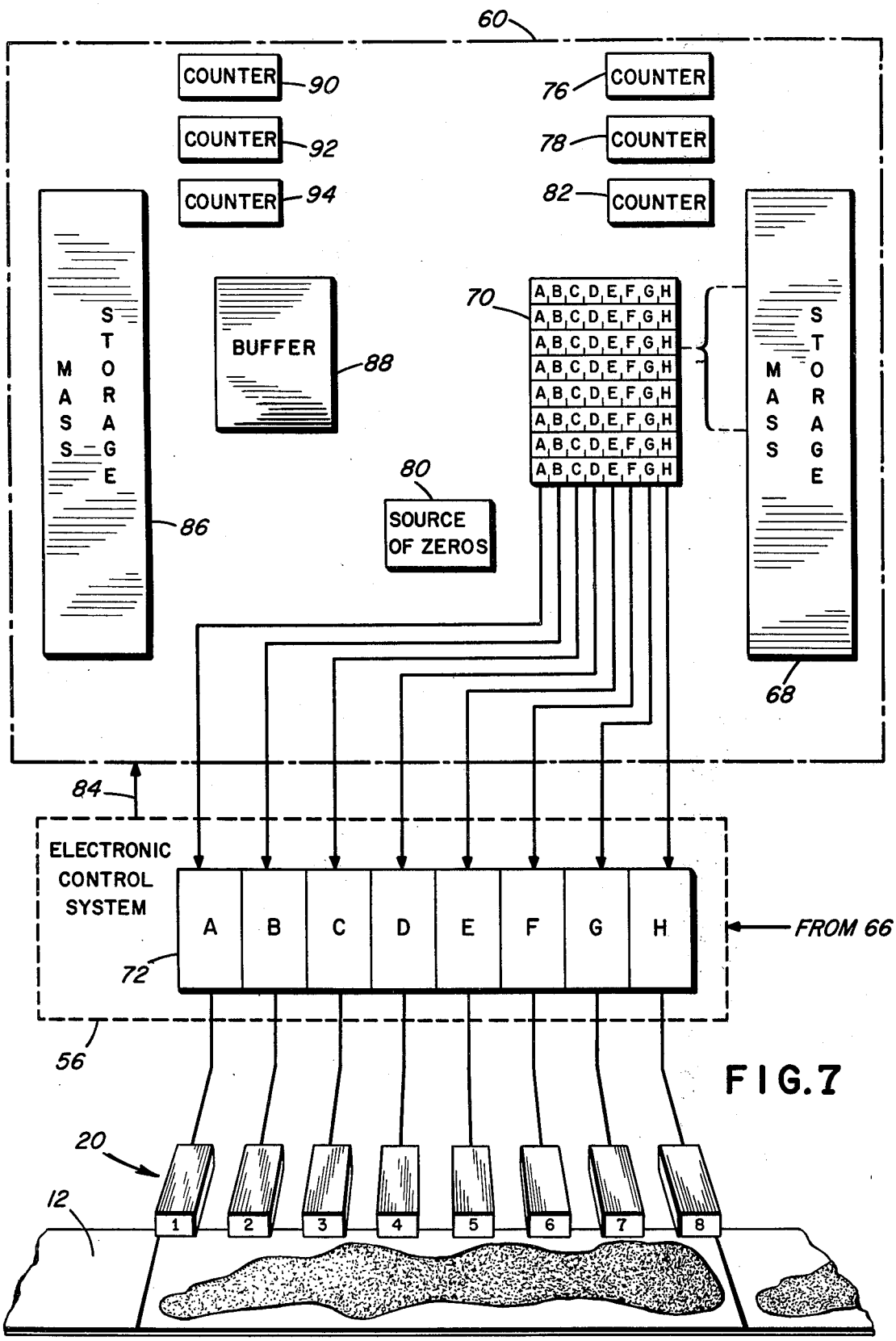
FIGS. 7–9 show schematically the apparatus and several modes of operation of the present invention.
Figure 8:
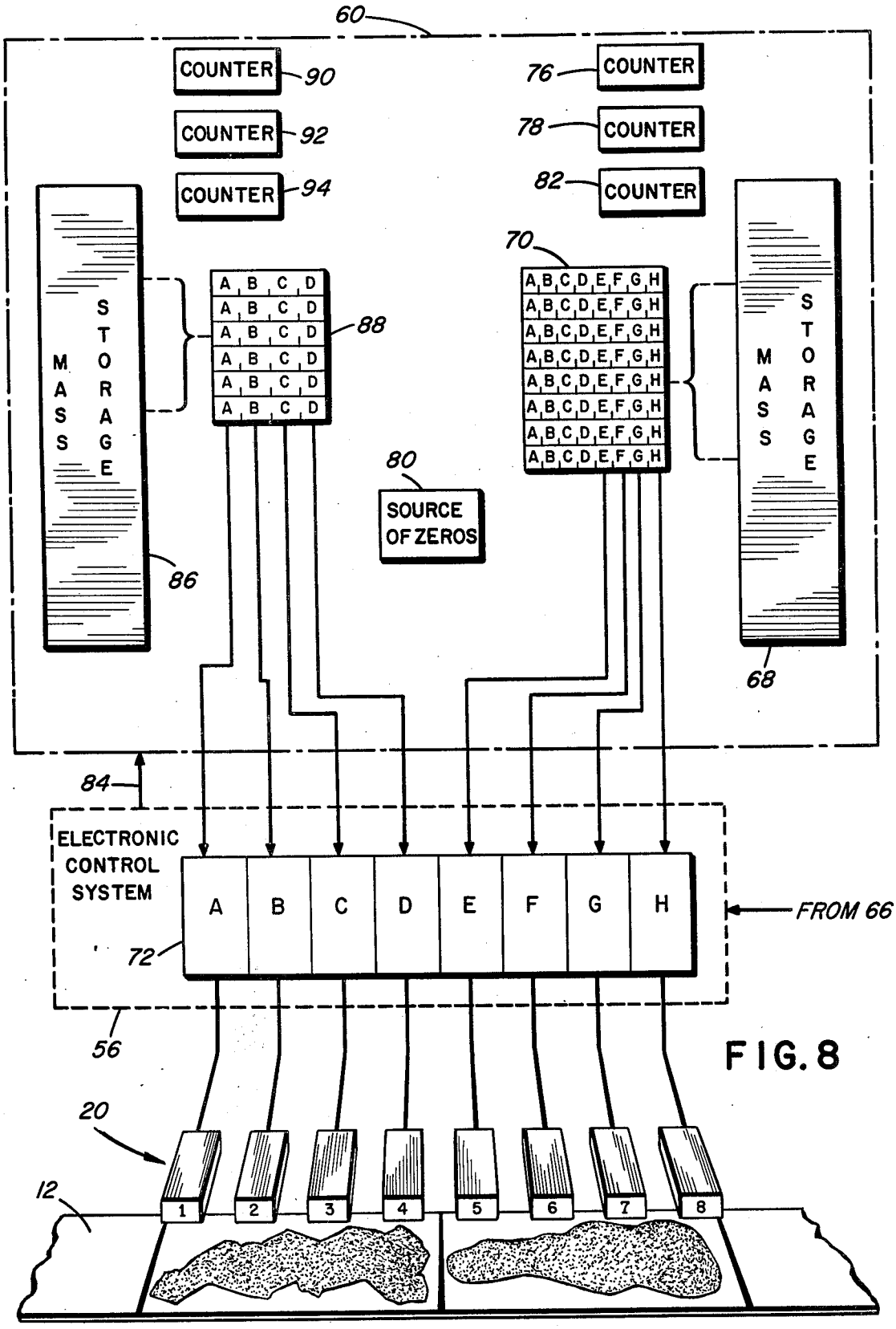
Figure 9:
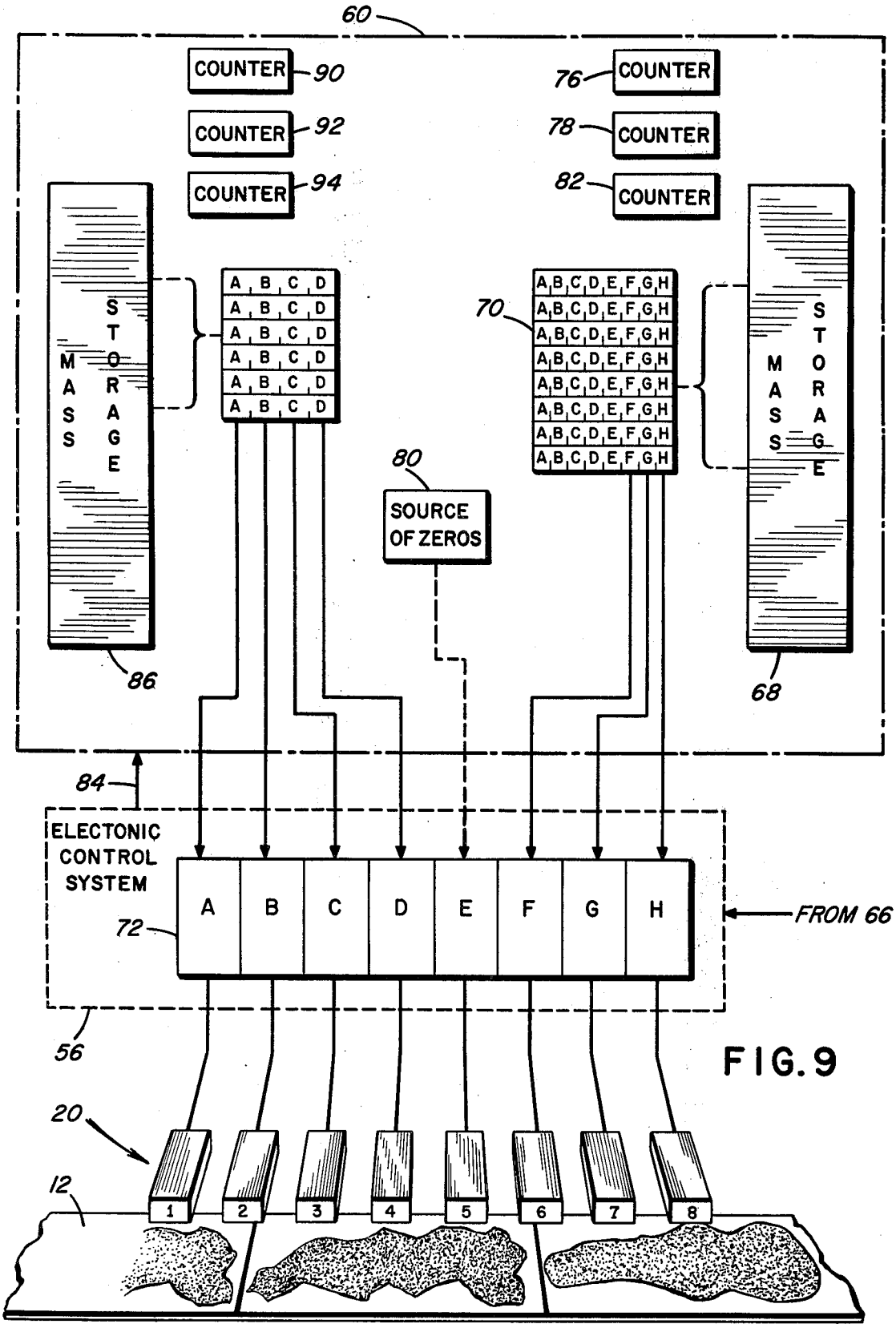

FIGS. 7, 8 and 9 illustrate schematically the method and apparatus and several modes of operation of the present invention. For printing a number of repeats of one pattern there is used the mass storage means or disk 68, buffer means 70, and counters 76, 78, shown in FIG. 5, as well as a source 80 of 0's, and counter 82 which counts the number of gun bars used to print the pattern. Source 80 is one gun bar worth of 0's stored in core. In addition, there is also employed a second mass storage means 86 such as a disk which stores data for another pattern, another buffer means 88 which temporarily stores sections of data from disk 86, a counter 90 which counts the number of lines of data in buffer means 88, a counter 92 which counts the number of repeats required for the other pattern and a counter 94 which counts the number of gun bars used to print the other pattern.

FIG. 7 shows the mode of operation for printing a number of repeats of one pattern. This one pattern, for example, uses 8 different colors and, therefore, data is required for the 8 gun bars #1–#8. Assume a section of data from disk 68 is stored in buffer means 70 and start-up of the gun bars has been completed. When conveyor 16 moves 1/10", control system 56 receives a line request from registration system 66 and sends a signal over line 84 to the computer 60 to request a group of data. At this time subgroup data A of one line of data in buffer means 70 for gun bar #1 is sent to a machine storage 72. When this operation is complete, subgroup date B in this one line for gun bar #2 is sent to machine storage 72, and when data B is stored in storage 72, subgroup data C is then sent to storage 72, etc., until this entire line or group of data is transferred to storage 72. This operation is in contrast to that described in connection with FIG. 5 where an entire group of data in buffer means 70 is transferred simultaneously to storage 72 on receipt of a line request.

The transfer of each subgroup of data from buffer means 70 to storage 72 is monitored by counter 82 which is set to a count corresponding to the number of gun bars used for printing the particular pattern, i.e., the number of subgroups of data A–H. As each subgroup is transferred to storage 72, counter 82 is adjusted accordingly, and when it indicates that all data in one group has been transferred to storage 72, counter 76 is adjusted accordingly to indicate one group or line of data has been emptied from buffer means 70. Whenever counter 76 indicates the buffer means 70 is about to be completely emptied of data, a new section of data from disc 68 is selected and sent to buffer means 70.

When the last line of the last repeat of the pattern being printed is passing gun bar #1 and a new pattern is not required, it is time to start sequentially stopping gun bars #1–#8 from firing. Now, rather than clearing data for the appropriate gun bar in the buffer means 70, as is done in connection with FIG. 5, source 80 supplies 0's to sections of machine storage 72 at appropriate times. Thus, when the last line of the last repeat passes only gun bar #1, source 80 supplies 0's to the section of storage 72 which stores data A, and data B–H from buffer means 70 is transferred into the remaining sections of the machine storage 72. This continues until the last line passes gun bar #2 at which time source 80 supplies 0's to the sections of storage 72 storing data A and B, with sections C–H receiving pattern data from means 70, and so on until source 80 supplies 0's to all sections of storage 72, thereby causing all gun bars #1–#8 to cease firing sequentially.

FIG. 8 shows the mode of operation where a change from one pattern to another pattern is required. Prior to the change, the repeats of the one pattern are produced in the same manner as described with respect to FIG. 7. During the time when the one pattern is being produced by the gun bars, the other pattern is being readied by transferring a section of data for the other pattern from disk 86 to buffer means 88. When the last line of the last repeat of the one pattern is completed by gun bar #1, data A for gun bar #1 is transferred from buffer means 88 to machine storage 72 while data B–H for the remaining gun bars #2–#8 is transferred from buffer means 70. The data is sent from buffer means 88, 70 to storage 72 subgroup by subgroup, as already indicated in describing the mode of operation of FIG. 7. This continues until the last line of the last repeat of the one pattern is completed by gun bar #2, at which time data A and B are transferred from buffer means 88 and data C–H transferred from buffer means 70 to the machine storage 72. This process continues with more and more data being taken out of buffer means 88 and less data taken out of buffer means 70 as the first repeat of the other pattern is located under additional gun bars.

FIG. 8 shows an example where the one pattern uses all 8 gun bars, while the other pattern uses only 4 gun bars; hence, buffer means 88 stores only 4 subgroups A–D of data. FIG. 8 also shows the example where the one pattern is under gun bars #5–#8 and the other pattern is under gun bars #1–#4. Hence, at this time information for four gun bars is taken from each of buffer means 88, 70.

FIG. 9 shows the example where the one pattern has moved under gun bars #6–#8 and the first repeat of the other pattern has moved under gun bars #2–#5. At this time gun bar #5 must not fire because the lines of the other pattern under this gun bar already have received the required colors from gun bars #1–#4. Also, gun bars #6–#8 must complete the one pattern and gun bar #1 must commence firing for another repeat of the other pattern. Accordingly, at this time, data A–D is transferred from buffer means 88 to machine storage 72 for gun bars #1–#4, source 80 supplies 0's to storage 72 for gun bar #5, and data F–H is transferred from buffer means 70 to the machine storage for gun bars #6–#8. Thus, at this time gun bars #1–#4 and #6–#8 will fire in accordance with data for the other and the one patterns, respectively, and gun bar #5 will not fire due to the data from source 80. When the other pattern moves under gun bar #6, machine storage 72 receives data A–D for gun bars #1–#4 from buffer means 88, 0's for gun bars #5–#6 from source 80 and data G–H for gun bars #7–#8 from buffer means 70. This process continues until finally the last line of the last repeat of the first pattern clears gun bar #8, at which time machine storage 72 receives only data A–D from buffer means 88 for gun bars #1–#4. At such time source 80 supplies no 0's for gun bars #5–#8, but these gun bars do not fire as if such 0's were received since solenoids 52 for these gun bars will be in their normally opened position.

After changing from printing the one pattern to the other pattern, a predetermined number of repeats of the other pattern may be printed in the same manner as the previous pattern. Counter 94 counts the number of subgroups of data A–D of a group in buffer means 88 and counter 90 is adjusted each time a group of data is transferred to storage 72. When counter 90 indicates that buffer means 88 is about to be emptied, a new section of data from disk 86 is sent to buffer means 88. Each time the last section of this data is used, counter 92 is decremented by 1 and when this counter indicates that the last section of the final repeat of the other pattern has been used, the gun bars can be caused sequentially to stop firing by forcing 0's from source 80 into machine storage 72 at appropriate times as already described.

In the above example, there was a change from using a greater number of gun bars (8) to a fewer number of gun bars (4) when switching printing patterns, and source 80 had to supply 0's during the change. If, however, there is a change from using a fewer number of gun bars to using a greater number of gun bars when switching printing patterns, the source 80 will not have to supply 0's during the change as it does when the reverse is true. Also, in the present invention, on start-up (as at all other times) source 80 does not clear data from the buffer means 70 as described in connection with FIG. 5; rather, only subgroups of data are transferred to machine storage 72 depending on the number of gun bars under which the first line of the first repeat has passed. Therefore, with the present invention source 80 supplies 0's only when sequentially stopping the firing of the gun bars and when changing from using a greater number of gun bars to a fewer number, with one exception now to be described.

There has been described a mode of operation in which there is no gap in the carpet when switching printing from one pattern to another. However, the present invention has the capability of providing a specified amount of unprinted carpet between patterns. A few lines of unprinted carpet between patterns may be useful for cutting purposes to separate the different patterns. This specified amount can be provided by delaying the data for the new pattern, gun bar #1 from being transferred to machine storage 72 when the change in printing of patterns is occurring. In place of such data, source 80 can supply 0's to storage 72 to prevent gun bar #1 from printing the new pattern for a predetermined number of pattern lines on the carpet, such as 30.

While there has been described two mass storage means 68, 86, the data for the patterns may be permanently stored in a single mass storage means with appropriate access being made to transfer sections of data for each pattern to buffer means 70, 88. Furthermore, while there has been discussed the printing of two different patterns, any number of different patterns may be similarly printed, as will be described.

Furthermore, while buffer means 70, 88 have been shown as single elements, each means comprises two buffers. Each of these two buffers alternate as both an input buffer and an output buffer. When data is transferred from a buffer to storage 72 it is an output buffer and when data is readied for transfer into a buffer from a disk, it is an input buffer.

There will now be described in flow chart form commonly used by those skilled in the art of computer programming a more detailed description of the invention. FIGS. 10A–10D show tables and lists of variables used in processing the pattern data according to the teachings of the invention. FIG. 10A is a pattern table which lists specific items used for each pattern stored in the disk 68 which is to be printed. The pattern table is entered into computer 60 by the operator of the machine prior to beginning the run of the first of the desired patterns and has 5 entries for each pattern, each entry being a digital word representing particular information. These entries include (1) the number of gun bars used to print the pattern; (2) a disk address identifying where the beginning of the pattern is located on the disk 68; i.e., where there is stored in the disk the group of data for the first pattern line to be printed; (3) a pattern length which is the number of pattern lines in the pattern; (4) the number of repeats of the pattern to be printed; and (5) the pattern width.

The number of gun bars used is equal to the highest number gun bar receiving pattern data from disk 68 to print a particular pattern. For example, a pattern may require only 3 colors, the dyes being stored, respectively, in gun bars #2,3 and 6. Here, the number of gun bars used will be 6 because pattern data will not only be stored in disk 68 for gun bars #2,3 and 6 but also for gun bars #1, 4 and 5. This latter pattern data will be such as to prevent gun bars #1, 4 and 5 from firing and comprises all 0's. Gun bars #7, and 8 will not receive pattern data and therefore will not be activated to fire.

The reason why gun bars #1, 4 and 5 and not gun bars #7–8 have to receive 0's as pattern data is as follows. With reference to FIG. 7, data is transferred from, for example, buffer means 70 gun bar by gun bar into machine storage 72. If the buffer means had pattern data only for gun bars #2, 4 and 6 then the data for gun bar #2 would be transferred into position A of storage 72, followed by the data for gun bar #3 in position B, followed by data for gun bar #6 in position C. Thus, gun bars #1–3 would receive data intended for gun bars #2, 3 and 6. By providing 0's as part of the pattern data to prevent gun bars from firing, those gun bars #2, 3 and 6 which are supposed to fire will fire, and gun bars #1, 4 and 5 will not fire since they will receive the 0's. Since machine storage 72 will have stored the proper pattern data for gun bars #1–6, no pattern data is required for storage locations corresponding to G and H and gun bars #7–8 therefore also won't fire.

The pattern width is equal to the word count × the number of gun bars used. The word count is a constant and equal to the number of computer words comprising the number of bits required to control the valves 52 for one gun bar. Thus, the word count is the number of words comprising, for example, subgroup A.

FIG. 10B shows an output table which contains the information required to transfer a "current" line or group of data from an output buffer to machine storage 72 when a line request is received. While there may be, for example, 6 patterns set up in the pattern table, the output table includes information only for any two patterns which will be identified as pattern #1 and pattern #2, such as the fourth and fifth patterns in the pattern table, respectively.

For both pattern #1 and pattern #2 there are four entries in the output table, each entry being a digital word representing certain information. These entries include (1) the number of gun bars to output which is the number of gun bars to receive pattern data from an output buffer; (2) a line address which identifies in the output buffer the location of the first word of a particular line of data when a line request is made, this line in the output buffer being termed the "current" line; (3) the word count; and (4) the first gun bar to output which is the first gun bar in the current line to receive pattern data. For example, with reference to FIG. 9, when the first pattern is under gun bars #6–8, the number of gun bars to output listed in the output table for this pattern will be 3 since these gun bars have to receive data, and the first gun bar to output will be #6. At this time the second pattern is under gun bars #2–5 and the number of gun bars to output listed in the output table for this pattern will be 4 (3 gun bars #2–4 for the first repeat and 1 gun bar #1 for the second repeat), and the first gun bar to output will be #1.

FIG. 10C gives a list of variables/counters for pattern #1 and pattern #2. Each of these are in the form of a digital word representing, respectively, (1) the number of repeats needed to be printed for each pattern (i.e., the count in counters 78 or 92); (2) the number of the first line of data stored in the input buffer; (3) the pattern length; (4) a disk address; and (5) the line number to request from the output buffer. The first line number in the input buffer is the number of the first line or group of data in the section transferred from the disc 68 to the input buffer; for example, this first line may be number 50 of the number of lines of data stored in the disk for a particular pattern. The line number to request after the input buffer switches and becomes the output buffer may be 52.

The information listed in FIG. 10C except for pattern length are variables because during a run of a given pattern items #1–2, 4–5 will vary to output the correct data and print the required number of repeats; the pattern length of course is constant for a particular pattern. However, the pattern length is listed as a variable because as between pattern #1 and pattern #2 the pattern length may be different. If pattern #1 and pattern #2 have a different number of pattern lines then their lengths will be different, while if they have the same number of pattern lines their lengths will be the same.

Also, for purposes of ease of explanation FIGS. 7–9 were shown and described as including counters 76, 78, 82, 90, 92, 94. However, only counters 78 and 92 actually are counters which count the number of repeats which have been printed. The other "counters" are not counters; rather, in accordance with standard computer programming practice the information of these "counters" are values representing a means of determining when a buffer is empty ("counters" 76, 90) and how much data to output to machine storage 72 ("counters" 82, 94), as will become apparent from the description of the program.

FIG. 10D gives a list of system variables and these include counts in start and stop counters (not shown) located in the computer 60, and the start and stop length. These lengths will vary depending on the number of gun bars used for a particular pattern, and the information stored in the start and stop counters is used to start respective gun bars printing a pattern and stop respective gun bars from printing such pattern. The start length is the number of lines on the carpet to pass gun bar #1 before the first line of the pattern passes the final gun bar used; the stop length is the number of lines on the carpet to pass gun bar #1 before the last line of the pattern passes the final gun bar used. For example, for start-up or stopping a pattern printed by gun bars #1–5, and with each gun bar 150 pattern lines apart, the start and stop lengths are $4\times150=600$ lines. As each one of the first 600 lines of carpet passes beneath gun bar #1 the start count in the start counter is incremented by 1 and when a count of 600 is reached there is a complete start up with gun bars #1–5 firing. As each one of the first 600 lines on the carpet subsequent to the last line of the last repeat passes gun bar #1, the stop counter is incremented by 1 and when a count of 600 is reached there is a complete stop with gun bars #1–5 not firing. At counts in the start and stop counters of multiples of 150, a gun bar starts or stops printing a pattern. Similarly, if the pattern being printed uses 8 gun bars the start and stop lengths will be 1050 with a gun bar started or stopped at multiples of 150.

The system variables also include (1) a pointer to the "current" pattern #1 in the pattern table to point to the pattern being printed, (2) a stop data flag which stops the output of data from a buffer after the sequential stopping of all the gun bars, (3) start and stop requested flags which are initiated by a machine operator pressing appropriate buttons on a machine console or by the program to start or stop the printing at the end of a repeat, (4) pointers to each of the input and output buffers, respectively, of buffer means 70,88, and (5) a delay length and delay counter which are used to provide a small gap between different patterns.

Figure 11:
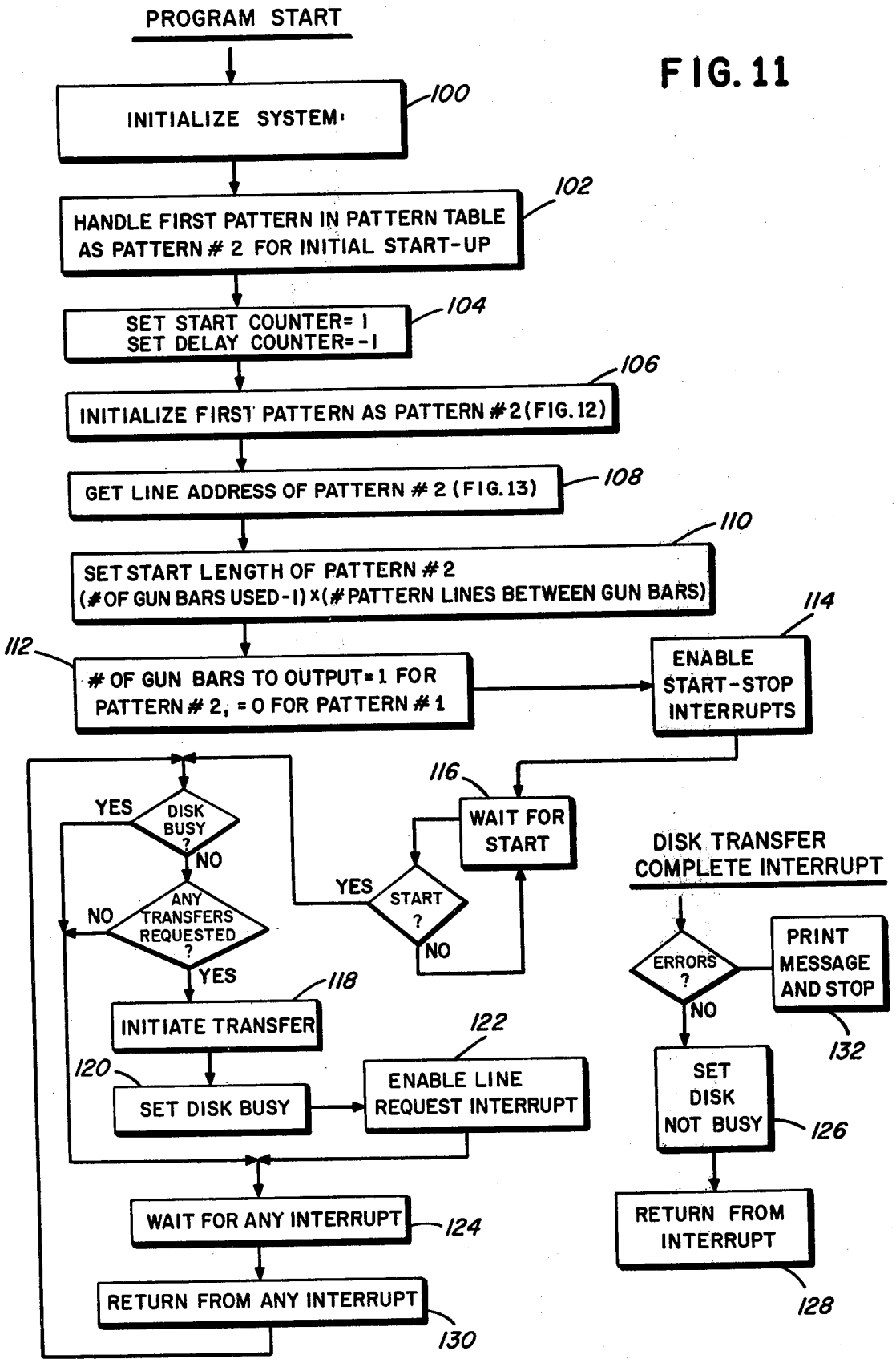
FIG. 11 is a flow chart for starting the printing of the initial pattern and readying pattern data for printing patterns.

FIG. 11 illustrates a flow chart for the start of the program to prepare for printing the first repeat of the first pattern to be printed and to maintain the input buffers of means 70, 88 filled with pattern data. On the disk 68 there may be stored, for example, 100 patterns. The machine operator, prior to the program start, selects a number of these patterns and sets up the pattern table having the five entries for each of the selected patterns.

After the pattern table is completed the program is started and first initializes the system (block 100). The pointer for the current pattern #1 is set to point to the first pattern in the pattern table. The pointers to the input and output buffers of means 70, 88 are initialized so that each points to one of the four buffers. The start and stop counters are set to $-1$ to indicate that no start or stop is in progress at this time. The stop data flag is cleared to allow data to be transferred from an output buffer when a line request is received and the start and stop requested flags controlled by the machine operator are cleared.

When starting up any pattern at any time, such pattern is handled as pattern #2. After start-up of the pattern being printed in completed, the pattern is handled as pattern #1 (with one exception described below). Consequently, after the system is initialized (block 100), the first pattern in the pattern table is handled as pattern #2 for initial start-up of machine 18 (block 102). To do this the pointer to current pattern #1 is reset to point to a pseudo pattern number 0 in the pattern table, which location doesn't exist. Thus, logically the first pattern in the pattern table is handled as pattern #2. The start counter is then set equal to 1 indicating there will be a start-up of pattern #2 (block 104).

Figure 12:
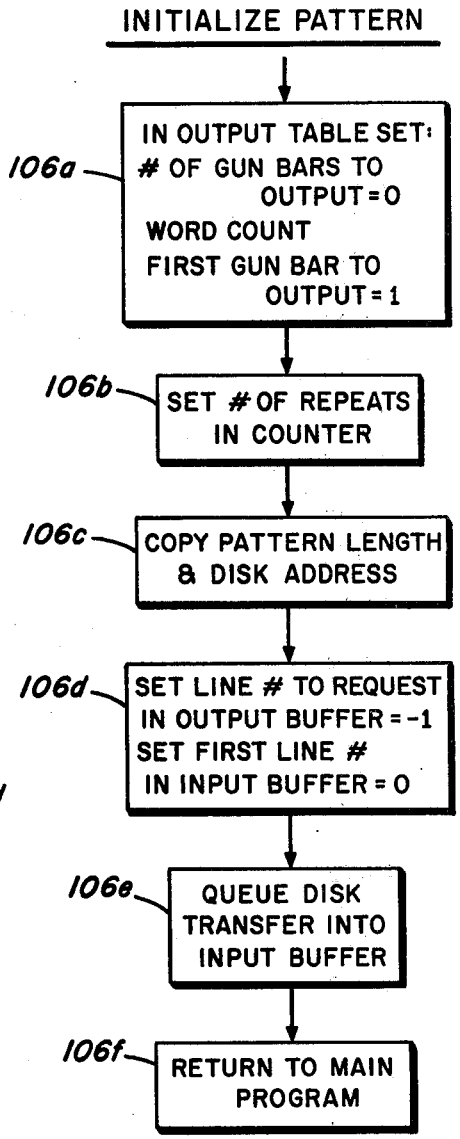
FIG. 12 is a flow chart for initializing a pattern.

The first pattern in the pattern table is now initialized as pattern #2 (block 106) and this is performed by a subroutine shown in FIG. 12. The entries in the output table for pattern #2 are set (block **106*a*). The number of gun bars to output=0 to make sure the gun bars will not fire at this time. The word count is recorded in the output table and the first gun bar to output is set equal to #1 for when it is time to start-up the printing of a repeat of pattern #2. The number of repeats for this pattern #2 is set in, for example, repeat counter 78 (block 106*b*) and this information is obtained from the pattern table. A copy of the pattern length and disk address is then made from the pattern table (block 106*c*) for later use. The line number to request from the output buffer of buffer means 70 is set to $-1$ and the first line number in the input buffer of buffer means 70 is set to 0 (block 106*d***).

The information for disk transfer of data into the input buffer of means 70 is then queued so that at the proper time a disk transfer can be made (block **106*e*). This includes placing in a list the disk address copied for pattern #2 and a buffer address which informs where in the core of the computer 60 the buffer means 70 is located. The subroutine is now complete and there is a return to the main program (block 106***f*).

As shown in FIG. 11, the next step is to obtain the line address (block 108) for pattern #2 to output a line from the output buffer of means 70 when a line request is received. This is performed by another subroutine shown in FIG. 13. The line number to request in the output buffer of means 70, which is set to −1 upon initialization of the pattern (block 106*d*), is incremented by 1 to 0 (block 108*a*). If the line number to request in the output buffer of means 70 (or 88) is equal to the first line number in the input buffer, as they are during this initialization of the pattern, the input and output buffer pointers for these two buffers are switched so that the output buffer becomes the input buffer and vice versa (block 108*b*).

The line number to request in the input buffer is then adjusted if it is greater than the pattern length (block 108*c*). More particularly, the input buffer which, for example, may have a capacity of 33 lines, should be filled at all times. If, for example, the pattern being printed has a pattern length of 100, the output buffer may store lines 98–100 and lines 1–30 for the end of one repeat and the beginning of another repeat. When reading out this data from the output buffer, the line number to request is allowed to go from 98 to 130. The next section of data stored in the input buffer begins with line 31; therefore, rather than allowing the line number to request to go to 131 it is adjusted to number 31.

Then, the first line number in the input buffer of means 70 and the disk address are calculated to determine from where in disk 68 a new section of data is to be transferred (block 108*d*). This line number is equal to the first line number in the output buffer plus the number of lines of data storable in the output buffer. For example, at the present time of start-up the first line number in the output buffer is 0 and if there are 33 lines of storage in this buffer then the first line number in the input buffer is 33. The disk address is equal to the initial disk address given in the pattern table+(pattern width×the first line number in the input buffer). This determines how many words down in the disk from the initial disk address the first word of the new section of data to be transferred to the input buffer is located. Then, a transfer of data from the disk 68 to the input buffer of means 70 is set up beginning at the first line number which was calculated (block 108*e*). This set-up includes gueuing the calculated disk address and the buffer address to transfer another section of data into the input buffer (block 108*f*). Thus, after the step of block 108*f* is performed for start-up of the initial pattern in the pattern table, there are two queues for disk transfers of data into the two buffers of means 70.

Figure 13:
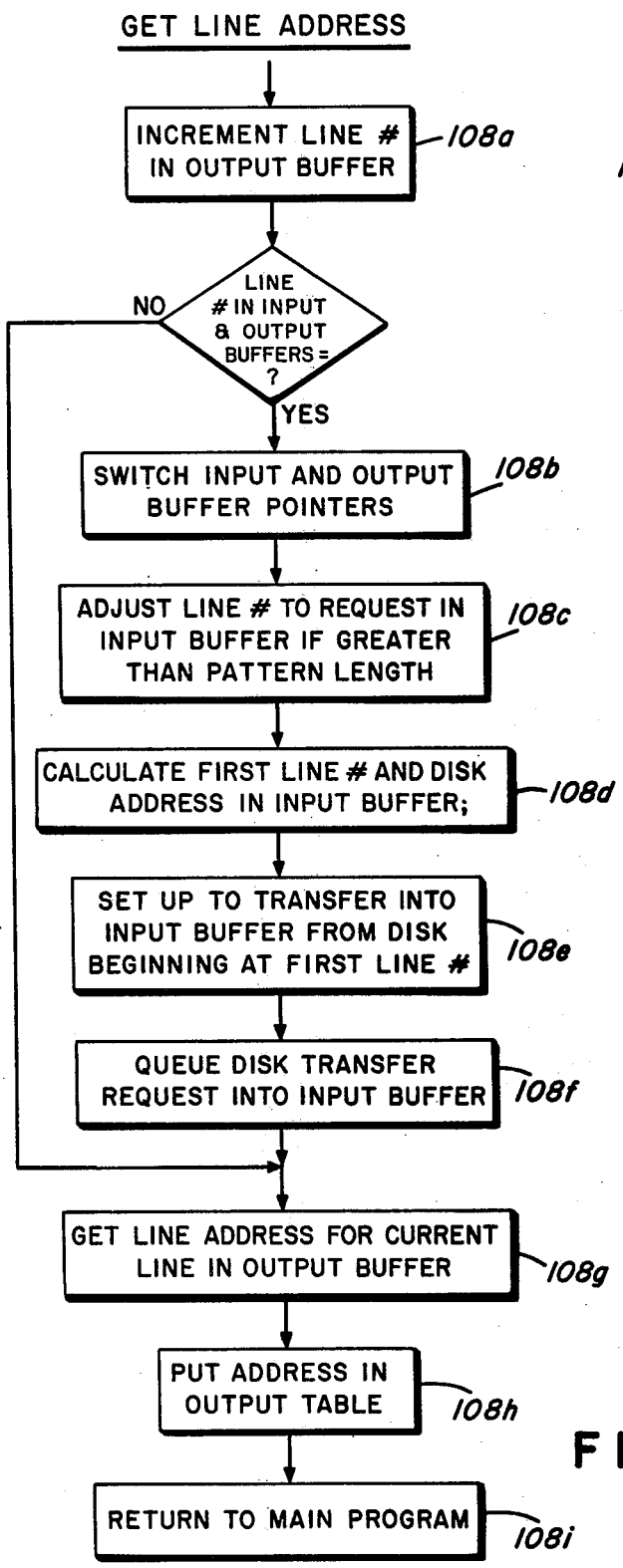
FIG. 13 is a flow chart for obtaining a line address to output pattern data.

To complete this subroutine of FIG. 13, the line address for the current line stored in the output buffer is calculated (block 108*g*). The line address is calculated by known the first line number in the output buffer and the line number to request upon receipt of a line request. The line address is obtained by subtracting the first line number in the output buffer from the line number to request (which is obtained from block 108*a*) are multiplying the result by the pattern width. Thus, for example, if the first line number is 50 and the line number to request is 60 then the subtraction is 10 which is then multiplied by the pattern width. For start-up of the initial pattern (block 106) these two numbers are 0. This gives the position of the first word of the current line in the buffer. The buffer address is then added to such number giving the absolute position of the first word in the core. The line address is then placed in the output table (block 108*h*), and there is a return to the main program (block 108*i*).

With reference again to FIG. 11, after calculating the line address for pattern #2, the start length for this pattern is set and, as already indicated, is equal to the (number of gun bars used −1)×(the number of pattern lines between two gun bars) (block 110). In the output table the number of gun bars to output for pattern #2 is now set equal to 1 and for pattern #1 to 0 (block 112). The reason for this is that when starting-up the initial pattern is the pattern table there is no pattern #1 but only a pattern #2. Furthermore, when the first line of the first repeat of pattern #2 passes under gun bar #1 only this gun bar should receive pattern data; therefore, at such time there is data sent from the output buffer of means 70 only to one gun bar.

The program then enables the computer to receive start and stop interrupts initiated by an operator pressing a start or stop button (block 114). Before continuing the program waits to see if the machine operator pressed the start button to commence printing a pattern (block 116) and if there is no start the program continues to wait. If there is a start and the disk 68 is not busy transferring data to one of the buffers of means 70 and transfers of data from the disk 68 have been requested, then a transfer of data from the disk for pattern #2 is initiated (block 118) (at the time of initial start-up of the first pattern in the pattern table, transfers are made only for pattern #2, while at other times they are made for pattern #1 and/or pattern #2). Transfers are requested by the presence of a disk address and buffer address created by queue operations already described, and, consequently, upon initiating the transfer there is a transfer of the data into one of the buffers of means 70 as specified by one of the queue operations. With the transfer occurring, the disk is set busy (block 120), the computer is enabled to process a line request interrupt when it occurs (block 122), and the program then waits for any interrupt (block 124). An interrupt may be a signal that the disk transfer is complete, or a line request, or the result of the operator pressing the start or stop button. If any interrupt is received it is processed as will be described.

The loop involving blocks 118, 120, 122, 124, 130 is a loop which is executed any time a return from interrupt occurs to check if disk transfers have been requested. Consequently, when an interrupt does occur it is possible for the program to be in any point of the loop and the execution of the loop is temporarily stopped. As soon as the interrupt is processed and there is a return from interrupt, the execution of the loop will continue.

As shown in FIG. 11, if a disk transfer is complete, as when one of the queue operations has been processed, and there are no errors in the transfer, then the disk is set not busy (block 126) and there is a return from interrupt (block 128). If there is an error, a message is printed and the program stopped (block 132).

When there is a return from interrupt (block 128) after completing a disk transfer for one queue operation, the disk is not busy and another transfer is requested because of the other queue operation described in connection with the start-up of the initial pattern. Therefore, a transfer is initiated in accordance with the other queue operation (block 118), the disk is set busy (block 120), the line to process a line request interrupt is enabled (block 122) and there is a wait for another interrupt (block 124). If the disk is busy or no transfers are requested, then no transfers are initiated and the program waits for an interrupt (block 124).

Figure 14A:
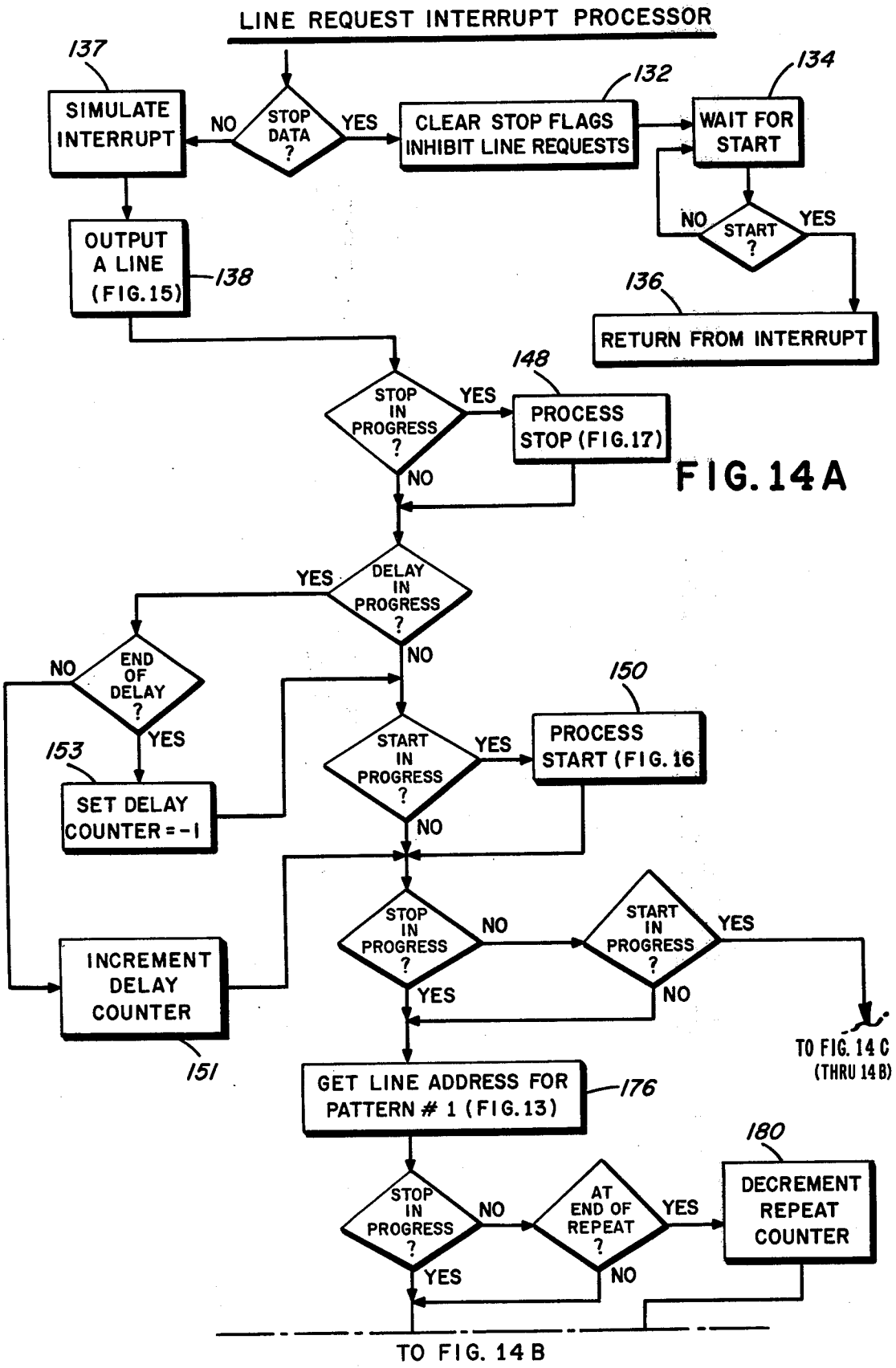

When the first disk transfer is complete for initial start-up of the first pattern in the pattern table, a buffer of means 70 has data stored for pattern #2, and computer 60 is ready to process a line request when it is received. The flow chart for processing a line request interrupt is shown in FIGS. 14A, B and C. When a line request is received, if data is stopped from being transferred from the output buffer of means 70 to the machine storage 72, because of a stop data flag, the line request is inhibited and the stop data and requested flags cleared (block 132). There is than a wait for a start (block 134), the start occurring when the machine operator presses a start button, as will be described in connection with FIG. 18A. If there is a start there is a return from interrupt (block (136).

If there is no stop data flag then a line of data should be transferred form the output buffer of means 70 to the machine storage 72 (block 138). (Prior to going to the routine "output a line" (block 138) an interrupt is simulated (block 137) for reasons which will be made clear later.) The program is now ready to output such a line and this is shown in FIG. 15 which is the flow chart for outputting a line from an output buffer. The discussion of this flow chart will continue assuming the condition of start-up and remembering that on start-up of the initial pattern in the pattern table there is no pattern #1 and the gun bars are sequentially turned on.

On start-up of the initial pattern there is no data to output to machine storage 72 for pattern #1 and this information is obtained from the output table for pattern #1 which states that the number of gun bars to output=0 (block 112). There is data to output to the machine storage 72 for pattern #2 and this information is obtained from the output table for pattern #2 which states that the number of gun bars to output is 1 (block 112). Therefore, the output of the subgroup of data for gun bar #1 is initiated beginning at the line address obtained from the output table for pattern #2 (block 140). Then, the pointer to the output buffer points to the next subgroup of data in this line by calculating the line address for such next subgroup (block 142). The line address for this next subgroup equals the line address for the current subgroup in the current line+the word count. After pointing to the next data subgroup there is a return from interrupt (block 144) waiting for completion of the transfer of the current subgroup of data from the output buffer of means 70 to machine storage 72 for gun bar #1.

When the transfer of data from the output buffer of means 70 to the machine storage 72 for gun bar #1 for pattern #2 is complete there is a data interrupt as shown in FIG. 15. At this time the program determines if data has to be set to the machine storage 72 for any other gun bars. At the present time of start-up, the output table for pattern #2 shows the number of gun bars to output=1 and this number is decremented by 1 upon initiation of the output of data (block 140). Therefore, the number of gun bars to output in this output table is now 0, indicating that all data for pattern #2 has been transferred to the machine storage 72. If all the data in the current line of the output buffer had not been transferred to the machine storage 72, the output table would not=0 for the number of gun bars to output (as will be apparent from the discussion below) and this additional data would be transferred to the machine storage 72 (blocks 140, 142, 144) with a data interrupt generated after each transfer is complete.

When all the current line data has been transferred from the output buffer of means 70 to the machine storage 72, the next question is whether any logic 0's are required from source 80. As already stated, these are needed only when changing from a pattern using a greater number of gun bars to a pattern using a fewer number of gun bars or when stopping a pattern. Thus, at the time of start-up of pattern #2 no 0's are required from source 80. The next question is whether there is any data required for pattern #1 to the machine storage 72. Since at the time of start-up of the initial pattern there is no pattern #1 and the number of gun bars to output for it=0 (block 112), the answer is no and there is a return from interrupt (block 146).

While data is being transferred from the output buffer of means 70 to the machine storage 72, the program is continuing as shown in FIG. 14A. At the present time of start-up a stopping of the gun bars is not in process and hence a process stop is not serviced (block 148). However, assuming there is no delay in progress (which delay is used to provide a small gap between different patterns, as will be described), a start is in progress (block 150) and the flow chart for this sequence is shown in FIG. 16 which will now be described. The start counter is checked to see if it=0 indicating that a start is to be initiated, and this counter initially was set to 1 (block 104), thereby indicating that a start is in progress. Since the start counter does not=0, this counter is checked to determine the time to fire the next gun bar (block 152). As stated previously, each time a line on the carpet passes gun bar #1 the start counter is incremented by 1. Since the gun bars are 150 pattern lines apart, after gun bar #1 has commenced firing, when a count of 150 is reached it is an indication that gun bar #2 should fire pattern data. Thus, after gun bar #1 begins to fire, until the start counter reaches 150 there is no firing of gun bar #2 and the counter is incremented by 1 with each line of carpet passing gun bar #1 (block 154). After each time the start counter is incremented by 1, there is an exit (block 156) and the program continues (from block 150).

After exiting from block 150 (FIG. 14A), the program checks to see if a stop is in progress. At the present time a stop is not in progress, but a start is in progress and, therefore, the program continues as shown in FIG. 14C to obtain a new line address to output another line of data upon receipt of the next line request.

The first decision box in FIG. 14C asks if pattern #1 is the same as pattern #2. At the time of initial start-up pattern #2, which is the pattern to be printed, is not the same as pattern #1 since the latter does not exist, and the answer is no. (Pattern #2 also will not be the same as pattern #1 when switching from printing one pattern to printing another pattern). Therefore, a temporary pointer, not previously described, to be used only in block 160 is set to point to current pattern #2 in the pattern table (block 158). Similarly, if there is the stopping of one pattern whose run is being completed and the starting of a run of a different pattern, then the temporary pointer is set to the current pattern #2 in the pattern table. However, if during the middle of a run of one pattern the operator stops the process, he will then have to start the process with the same pattern to complete the run. Pattern #1 and pattern #2 will be the same under this condition. Therefore, the temporary pointer is set to current pattern #1 in the pattern table (block 159).

The line address is now obtained for the pattern indicated by such temporary pointer (block 160) by the routine shown in FIG. 13. With reference to such figure, if the first line number in the input buffer is now not equal to the line number to request in the output buffer, the program goes directly to calculating the new line address in the output buffer (block 108*g*). Then, the new line address is placed in the output table (block 108*h*) (for pattern #2 on start-up).

After obtaining this new line address (block 160), and as shown in FIG. 14C, it is determined if the end of a repeat is being printed. This is determined by comparing the line number to request with the pattern length for pattern #2. If they are equal, it is the end of a repeat and the repeat counter 78 is decremented by 1 to indicate another repeat has been printed (block 162) and there is a return from interrupt (block 164). If it is not the end of a repeat, the repeat counter is not decremented but there is a return from interrupt.

This routine, in which gun bar #1 is started up and new line addresses are calculated continuously, occurs for the first 149 pattern lines. When the start counter registers a count of 150 gun bar #2 is ready to fire together with gun bar #1. Therefore, with reference to FIG. 16, it is time to start-up the next gun bar but it is not the end of the start operation nor is it past the end of the start operation. Consequently, the number of gun bars to output in the output table for pattern #2 is increased by 1 (block 157), the start counter is incremented by 1 (block 154) and there is an exit (block 156). The above procedure shown in blocks 152,154,156,157 occurs for the next 149 pattern lines, and so on until the start operation has ended. Thus, if pattern #2 requires 8 gun bars, then the output table reads 8 when the first pattern line passes under gun bar #8.

After the end of start operation and after the output table has been adjusted to record the number of gun bars to output (block 166), if a stop is not in progress, a start not in progress is set by setting the start counter $=-1$, and the stop and start request flags are cleared (block 168). This is done in anticipation of a production run of a number of repeats of pattern #2. Then the pointers are swapped so that pattern #2 is processed as pattern #1 and the output table for the next pattern in the pattern table to be run is set up as pattern #2 (block 170). This is in preparation of switching to printing another pattern when the last repeat of the pattern being printed is completed. The new pattern #2 is then initialized in the same manner as the previously described pattern #2 and as shown in FIG. 12 to be ready to transfer data from its output buffer of means 88 to the machine storage 72 (block 172). The program then exits (block 174) from block 150 (FIG. 14A), and assuming neither a stop nor a start is in progress, the line address for pattern #1 is obtained in preparation of transferring to the machine storage 72 from the output buffer of means 70 the data stored in this buffer (block 176). Again, this line address is obtained as shown in the flow chart of FIG. 13. Then, with reference to FIGS. 14A,B, after obtaining the line address, if a stop is not in progress and the machine is not at the end of a repeat of pattern #1, and a start is not in progress, there is a return from interrupt (block 178) at block 130 to process disk transfers.

If a stop is not in progress but the machine is at the end of a repeat then the counter 78 is decremented by 1 to indicate that a repeat is completed (block 180). If after decrementing by 1 the counter 78$\neq 0$ another repeat of the pattern should be printed, and if no stop is requested and a start is not in progress, there is a return from interrupt (block 178) to perform any necessary disk transfers.

If after decrementing the counter 78 by 1 it$=0$ then the predetermined number of repeats of pattern #1 has been printed and the program prepares the data for switching to printing a new pattern. The stop length for pattern #1, which is the pattern whose last repeat is being printed, is set and is equal to the # gun bars used for pattern #1—1)$\times$(the number of pattern lines between two gun bars) (block 182). The program sets a stop requested flag to enable stop operation, and the stop counter is set$=0$ (block 184). If a stop is not requested by the operator and all the patterns listed in the pattern table to be printed have not been printed, the delay length and delay counter are set (block 185) to provide a small gap between different patterns, if desired, and a start requested flag is set to enable a start (block 186). The start length for the new pattern (pattern #2) is set (block 188) and there is a return from interrupt (block 178).

At this time the stop counter has been set$=0$ (block 184); therefore, with reference to FIG. 17, the start counter is set$=0$ in anticipation of starting up the new pattern to be printed. The last pattern line of the last repeat of pattern #1 has passed gun bar #1; consequently, in the output table the number of gun bars to output for pattern #1 is decreased by 1. Also, since gun bar #1 is not firing for pattern #1 the first gun bar to output for this pattern is gun bar #2 and hence this entry in the output table is increased by 1 (block 192). The stop counter is then incremented by 1 indicating that a stop is now in progress (block 194). The program then exits (block 196) from block 148 and, with reference to FIG. 14 A, if a start of the new pattern is not in progress due to a delay in progress to provide a gap between different patterns, and a stop is in progress, the line address for pattern #1 is obtained (block 176) to output a new line for the final repeat. There is then a return from interrupt (block 178) to eventually process a new line request.

With reference again to FIG. 17, when stopping a run at the end of the final repeat the stop counter$\neq 0$ when the last line of this repeat has passed gun bar #1. The stop counter is checked to determine if it is time to stop firing gun bar #2 (block 198). It will be time to stop firing gun bar #2 when the stop counter counts to 150. Consequently, for these first 150 lines counted by the stop counter, gun bar #2 will not be shut down; for each line the stop counter will be incremented by 1 (block 194), and the program will exit (block 196) from block 148 to process the next line request. When gun bar #2 has been shut down and it is not the end of the stop operation the output table is adjusted (block 192) to indicate that the number of gun bars to output has been reduced by 1 and the first gun bar to output has been increased by 1 for the pattern being stopped.

If it is the end of the stop operation, i.e., all the gun bars have stopped firing, then the number of gun bars to output is set$=0$ (block 200) indicating there is to be no more data from the output buffer for the pattern which is being shut down. The stop counter is set$=-1$ to indicate that a stop is not in progress and the stop request flag is cleared in anticipation of a possible other stop requested flag after start-up again (block 202).

Then, if a start is not requested no more data must be transferred to the gun bars; hence, the stop data flag is set to be sure to stop the data (block 204) and then the program exits (block 196). If a start is requested after setting the stop counter to −1 the program exits (block 196). This start is now processed (FIG. 16) and since the start counter=0 at this time the output table for pattern #2 is changed in that the number of gun bars to output for pattern #2 is adjusted to 1 in anticipation of this pattern using gun bar #1 on start-up (block 157).

With reference to FIG. 14 A, B, assume the machine is printing a repeat of one pattern which is not the final repeat and the machine operator presses the stop button. The stop requested flag is not checked until the end of a repeat at which time the counter 78 (or 92) is decremented by 1 (block 180). Since this counter≠0 and a stop has been requested, the start and stop lengths are set equal to each other (block 206). These lengths will be the same because the pattern that was stopped is the same pattern that will be started to complete the run when the operator next presses the start button. The stop counter is set=0 to begin a stop (block 208) and pattern #2 is set the same as pattern #1 for restarting the same pattern (block 210). This pattern #2 is initialized as shown in FIG. 12 for restarting purposes. Then, the count in one of the repeat counters 78 or 92 for pattern #1 is set in the other counter for pattern #2 to complete the run for the pattern with the desired number of repeats (block 212). After setting these repeat counters and with reference to FIG. 14C, pattern #2 is the same as pattern #1; therefore, the temporary pointer is set to current pattern #1, the pattern which was stopped (block 159), and the program continues as shown in this FIG. 14C. When there is a return from interrupt (block 164) any disk transfers are processed. If the operator has pressed the start button, a line request interrupt will be received and this request is processed as shown in FIG. 14A. Since a start of the repeat will be in progress the program continues according to block 150.

Thus far, in connection with FIG. 15, there has been described the situation when there is no data to be output from an output buffer to the machine storage 72 for pattern #1. There will now be described the situation when pattern #1 is to be printed and therefore there is data to output upon a line request.

The pointer is set to point in the output buffer storing pattern #1 data to the subgroup of data to be output; this sub-group is located by the line address which=(-the line address for subgroup A) +[the word count×(-the first gun bar to output −1] (block 216). This gives the location of the data in the current line that is to be sent to the first gun bar firing pattern #1 data. Then, it must be determined if the source 80 has to apply 0's to any of the gun bars. The number of gun bars receiving 0's from source 80 is equal to the first gun bar to output for pattern #1—the number of gun bars for printing pattern #2—1 (block 218). For example, as shown in FIG. 9, if pattern #1 uses 8 gun bars and pattern #2 uses 4 gun bars, and pattern #1 is under gun bars #6–8 and pattern #2 is under gun bars #1–4, then the first gun bar to output for pattern #1 is gun bar #6 and the number of gun bars printing pattern #2 is 4.

Therefore, the above equation is 6−4−1 which means that at this time only 1 gun bar receives 0's from the source. In this example, it will be gun bar #5. Continuing with the above example, since there is data to be output for pattern #2 and since four gun bars #1–4 are to receive data, the program continues through blocks 140, 142, 144 until data has been transferred from an output buffer to machine storage 72, with a data interrupt being generated after each of the 4 subgroups of data is transferred to the storage 72. Then, when all the data for gun bars #1–4 has been transferred, since there is a gun bar which has to receive 0's, source 80 outputs 0's for 1 gun bar (block 220), there is a return from interrupt (block 222) and a zeros interrupt is generated and processed as described below.

With the above example in mind, after source 80 has completed outputting 0's when only gun bar #5 receives them the zeros interrupt is generated and there is data which must be output to the machine storage 72 to complete the last repeat of pattern #1. Therefore, since zeros to all the gun bars are out and there must be an output of data for gun bars #6–8, the program first causes data to be transferred for 1 gun bar (#6 in the example), beginning at the line address (block 226). Then the pointer to the output buffer points to the next data subgroup to be output for pattern #1 as determined by the new line address (block 228). When this data for gun bar #6 is stored in machine storage 72, there is a data interrupt generated and since all the data for pattern #1 has not been transferred from the output buffer the process continues through blocks 226,230 and 228 until the machine storage 72 is filled with the appropriate data. After processing in accordance with block 228 and after all data for pattern #1 has been transferred to the machine storage 72 there is a return from interrupt (blocks 230 or 232 respectively).

If, as another example, the last repeat of pattern #1 using 8 gun bars is under gun bars #7–8, and the first repeat of pattern #2 using only 4 gun bars #1–4 is under gun bars #3–6, then two gun bars #5 and #6 must receive 0's from source 80. Consequently, under this condition after source 80 supplies 0's for gun bar #5 and the zeros interrupt generated, it has not outputted 0's for all the gun bars; therefore there is a return to block 220 where source 80 outputs 0's for another gun bar (#6). There is then a return from interrupt (block 222).

Figure 14B:
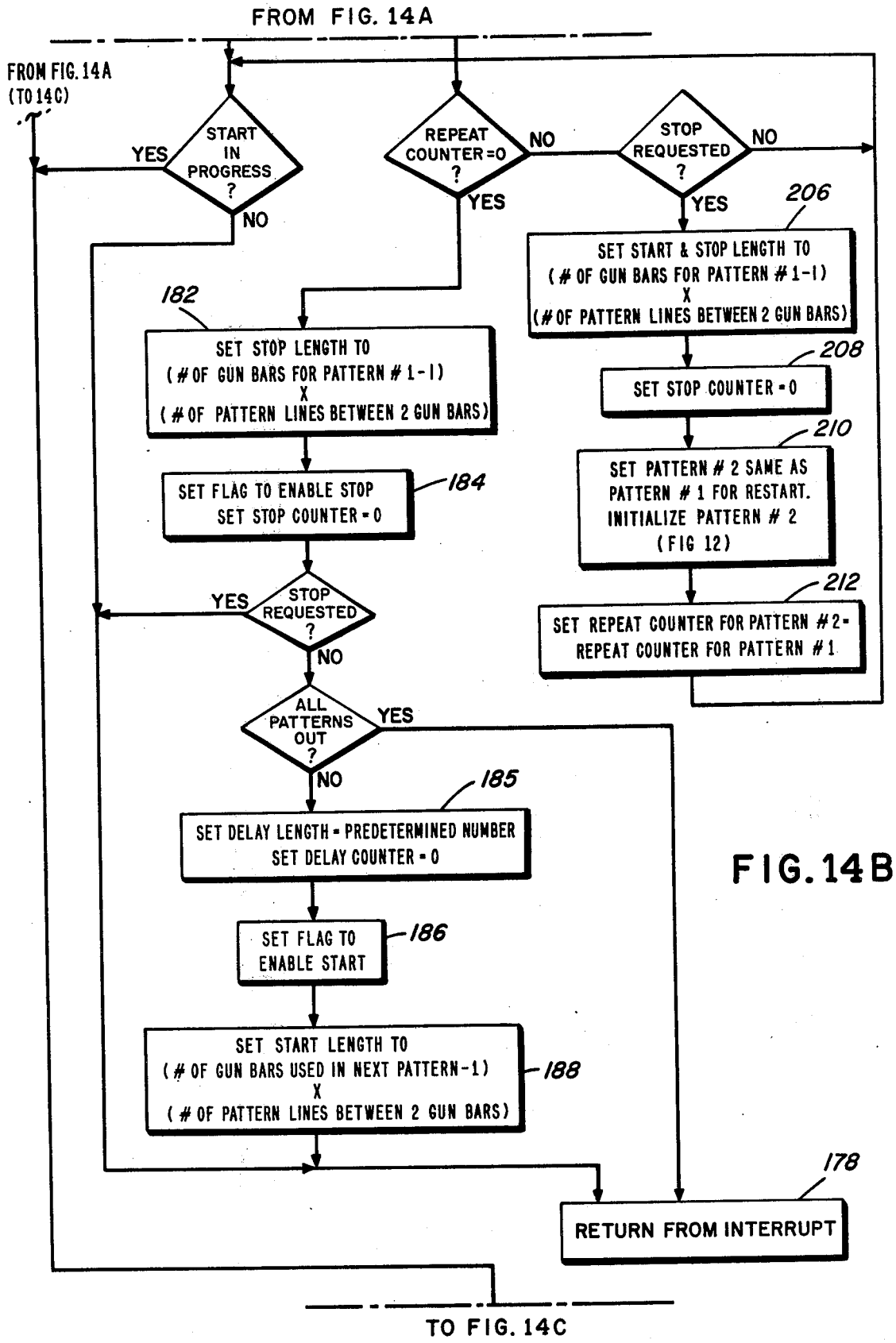

As has been noted, the present invention allows for a small gap or loss of material between two different patterns, and this is accomplished in the following manner. As shown in FIG. 11, block 104, in addition to setting the start counter=1, the delay counter (not shown) in the computer is set−1 to indicate that no delay is in progress during the program start. As shown in FIG. 14B, if the repeat counter=0 and all the patterns are not out, i.e. another pattern is to be printed, the delay counter is set 0, indicating a delay in starting the new pattern is to be initiated, and the delay length is set equal to any desired predetermined number of pattern lines, such as 25 corresponding to 2.5 inches. This number means that 25 lines of material will pass gun bar #1 after it prints the last line of the final repeat and before it prints the first line of the first repeat of the new pattern.

Then, with reference to FIG. 14A, after block 148, since a delay length is set, a delay is in progress. If it is not the end of the delay (the delay counter has not reached 25), the delay counter is incremented by 1 (block 151) and the program bypasses block 150 so as not to process a start of the new pattern. This continues until the delay counter 151 is incremented to 25, at which time there is an end of delay. Consequently, the delay counter is set=−1 (block 153), and since a start is now in progress it is processed as shown in block 150.

As has also been noted, as soon as start-up of a pattern is completed, this pattern is handled as pattern #1 rather than pattern #2; however, there is one exception of this rule which occurs when switching from printing a pattern using a greater number of gun bars to one using a fewer number of gun bars. As shown in FIG. 8, the start-up of the second pattern is completed. While the last repeat of the first pattern has not been completed. The first pattern must continue to be handled as pattern #1 until the last repeat is completed; therefore, there is a delay in switching the handling of the second pattern from pattern #2 to pattern #1. This is accomplished, as shown in FIG. 16, in that after the number of gun bars to output for pattern #2 is increased (block 166), with a stop in progress the program doesn't continue to blocks 168, 170, but returns to block 154 to increment the start counter, thereby delaying handling the second pattern as pattern #1 until the printing of the last repeat of the prior pattern is completed.

In FIG. 14A there is shown block 137 to simulate an interrupt. When the "output a line" (block 138) routine is in operation, there is a return from interrupt to output data for each gun bar except for gun bar #1; hence, an interrupt is simulated to output data for gun bar #1. Thus, to allow processing for the next line while the current line is being output, an interrupt condition is simulated (block 137) prior to going to block 138 so that data is transferred for gun bar #1. Upon the first entry to the line output routine (block 138), and as soon as the output of the current line is initiated (block 140 or 220 or 226) and a new line address is calculated (block 142 or 228), the return from interrupt (block 144 or 222 or 146 or 230) will cause the program to resume operation immediately after block 138. Thereafter (until the next line request is received), the line output routine operates on the true, not simulated, interrupt basis.

FIGS. 18A and 18B show, respectively, the flow charts for processing a start requested interrupt and stop requested interrupt initiated by the machine operator and described in this disclosure. When the operator presses the start button, the start requested flag is set (block 234) indicating a start has been requested, and there is a return from interrupt (block 236). Similarly, when the stop button is pushed, the stop requested flag is set (block 232), indicating a stop has been requested, and there is a return from interrupt (block 240).

What is claimed is:

1. A system for printing first and second different patterns on textile material, comprising:

(a) means for moving the material in a path of travel;

(b) a plurality of gun bars spaced apart in succession along the path of travel of the material, each gun bar having dyestuff to apply on the material in accordance with pattern data;

(c) first storage means for storing pattern data for the first pattern;

(d) second storage means for storing pattern data for the second pattern;

(e) third storage means for storing pattern data for both the first and second patterns, said gun bars being controlled by data in said third storage means to apply dyestuff on the material;

(f) means for periodically generating a signal to request that pattern data be transferred to said third storage means; and (g) means, responsive to said signal, for transferring data from said second storage means to said third storage means for a first predetermined number of successive gun bars beginning with the first gun bar, and then transferring data from said first storage means to said third storage means for a second predetermined number of successive gun bars subsequent to said first predetermined number.

2. A system according to claim 1 further comprising:

(a) means for providing additional data to said third storage means to prevent a gun bar from applying dyestuff on the material; and (b) means for transferring said additional data to said third storage means for a third predetermined number of successive gun bars after data is transferred for said first predetermined number and before data is transferred for said second predetermined number.

* * * * *

UNITED STATES PATENT AND TRADEMARK OFFICE

CERTIFICATE OF CORRECTION

PATENT NO. : 4,170,883

DATED : October 16, 1979

INVENTOR(S) : George C. Varner

It is certified that error appears in the above-identified patent and that said Letters Patent are hereby corrected as shown below:

In the specification, column 2, line 67, change "90'" to -- 9' --.

Column 3, line 61, change "addition" to -- additional --.

Column 8, line 60, change "from" to -- for --.

Column 9, line 23, change "date" to -- data --.

Column 14, line 36, change "in" to -- is --.

Column 15, line 49, change "gueuing" to -- queuing --;
line 58, change "known" to -- knowing --;
line 62, change "are" to -- and --.

Column 17, line 15, change "than" to -- then --.

Column 18, line 21, change "process" to -- progress --.

Column 23, line 3, change "of" to -- to --.

Signed and Sealed this

*Thirteenth* Day of *May 1980*

[SEAL]

*Attest:*

SIDNEY A. DIAMOND

*Attesting Officer* *Commissioner of Patents and Trademarks*